United States Patent [19]

Gosis

[11] Patent Number: 4,974,370

[45] Date of Patent: Dec. 4, 1990

[54] LAPPING AND POLISHING MACHINE

[75] Inventor: Anatoly Gosis, Palatine, Ill.

[73] Assignee: General Signal Corp., Stamford, Conn.

[21] Appl. No.: 280,932

[22] Filed: Dec. 7, 1988

[51] Int. Cl.[5] ..... B24B 7/00

[52] U.S. Cl. ..... 51/111 R; 51/117; 51/118; 51/131.3; 51/132

[58] Field of Search ..... 51/111 R, 117, 118, 51/272, 131.3, 132

[56] References Cited

U.S. PATENT DOCUMENTS

| | | | |
|---|---|---|---|
| 2,151,473 | 3/1939 | Hulbert et al. | 51/118 |
| 3,848,365 | 11/1974 | Bovensiepen et al. | 51/111 R |
| 4,593,495 | 6/1986 | Kawakami et al. | 51/118 |

*Primary Examiner*—Frederick R. Schmidt
*Assistant Examiner*—M. Rachuba

[57] ABSTRACT

This invention relates to a complete double lap lapping and polishing machine particularly to an apparatus designed to finish to a required thickness and/or finished polish workpieces such as thin silicon and/or ceramic wafers. The machine includes improvements in all of it's substructure components, including it's overall housing design, planetary gear drive, fluid cooling systems, positioning and locking of the upper lap plate in an inoperative position, an automatic thickness or sizing control, rotary union with automatic fluid liquid indicator and a slurry delivery and recovery system, all of which result in a more automated efficient use of the machine so as to produce a closer tolerance finished product.

31 Claims, 35 Drawing Sheets

LAPPING AND POLISHING MACHINE

PRIOR ART APPARATUSES

The lapping and/or polishing machine of this invention is novel in it's arrangement of structural elements whereby the dual lapping plates are rotatably supported from their underside. This arrangement necessitated new concepts for the supporting components which complete the machine whereby it can accomplish a highly effective lapping or polishing operation.

The conventional design and construction of dual lapping plate machines rotatably support the lower lap plate from it's under side while the upper lapping plate was carried by an overhanging structure suspending the upper lapping plate there beneath. Such a structure shown in U.S. Pat. No. 4,315,383 issued to Lawrence Day on Feb. 16, 1982. This earlier design required an enormous amount of head room for the machine necessitating a large room, with the machine occupying an inordinate amount of space.

Many prior machines of this type included planetary gear pin drives, such as are disclosed in U.S. Pat. Nos. 3,921,342; 4,009,539; 4,020,600; 4,240,231; 4,315,383; and 4,319,432.

These early designed gear pin drive mechanisms were expensive to maintain by reason of the excess wear created upon the gear pins by the successive engaging and disengaging of the tooth edge of the work piece carrier with such stationary pins. These prior gear pin drive mechanisms by reason of their fixed positioning interfered with open access to the lapping plate surface and it's surrounding work table necessitating the complicated handling of the work pieces prior and subsequent to the lapping or polishing thereof.

In early lapping machines the lower rotatable lap plate was supported by a rotary union. By their structural arrangement these earlier rotary unions were damaged by the accumulation of liquids spilling over from the lap surface during the lapping and/or polishing operation.

Notwithstanding that the earlier rotary unions attempted to seal the moving parts against contamination by liquids, these seals frequently failed and remained undetected until the accumulation of the liquids totaly rendered the rotary union ineffective.

The present invention provides a rotary union which possesses a liquid leak detector that will inform the operator of the presence of liquids before the same can accumulate and infect the union.

Prior machines required and provided for the cooling of the lap plates or polishing pads during operation. These past apparatuses fed cooling liquid upon the lap or pad surfaces or internally thereof, with the arrangement being that such cooling liquids would pass over the face of the plates or be caused to flow therethrough by centrifical force. Such early systems are disclosed in U.S. Pat. Nos. 3,562,964; 3,603,042; 3,992,820; and 4,471,579.

The present invention discloses a delivery and distributing system which eliminate the possibility of hot spots developing by an uneven or disrupted distribution of the cooling system.

Previously to the present invention most lapping and polishing machines provided a manually positioned splash guard preventing the slurry as employed in the operation from being spilled or sprayed around the surrounding area of the machine. Such splash guards are disclosed in U.S. Pat. Nos. 3,458,959; 4,007,560; 4,432,568; and 4,481,741. The present invention has a movable splash guard which is automatically raised or lowered in relation to the horizontal plane of the lower lap plate and it's surrounding work table, thus providing a guard that does not interfere with an efficient working process.

SUMMARY OF THE INVENTION

A new and novel dual lap plate polishing or lapping machine wherein both plates are cetrally supported from their undersides, with the uppermost lap plate hydraulically supported through a rotatable quill extending through the open center of the lower lap plate.

The novel design of the new structural concept as above noted is encased within a base which provides a surrounding work table formed with recessed access areas that provides ease of access over the entire circumference of the lapping machine without sacrificing desirable working table area.

The machine of the present invention is provided with a rotary drive pin arrangement for planatary lapping and polishing operations. To reduce or eliminate wear upon the drive pins during the work process the gear pins are provided with a stainless steel ball bearing thus reducing wear friction by converting contacting forces between the pins and the work carrier into rolling friction free contact.

The machine provides a method of height adjustment for the inner pin gear to secure proper positioning of the pins relative to the work piece carrier and lapping plate during the latter's profile change created by the normal wear of the lap plate created by the abrasive action between it and the work piece.

The outer pin gear drive is provided with a pneumatic height adjustment to compensate the position of the outer gear pins relative to the lap wear and for full removal through the horizontal plane of the work table to permit bulk parts loading and unloading.

The machine of this invention is provided with a multisectored cooling system for the lower plate to obtain positive uniform cooling thereof without deformations and thermal gradients.

The lower rotating lap plate of the present invention is provided with a rotary union with automatic leakage indicators. In supplying cooling and abrasive working fluids to the lower plate during it's rotation it is mandatory that such fluids be prevented from contaminating the rotary union and thus the present union is provided with a leak detector for indicating the presence of fluids between the rotary union parts before destruction of the same.

To provide a specially designed upper plate for the acceptence of abrasive slurry to be distributed from the under surface of the plate into the working area there is provided a pair of annular channels having different diameters with said channels providing means for delivering the fluid into the working area and to prevent over-flow of the same into non-working areas.

By reason of the novel under side rotary support of the upper lap plate there is required a method to secure proper vertical positioning of the pneumatic cylinder used for raising and lowering the plate, with said means avoiding binding or horizontal shifting of such cylinder during operation of the machine.

By reason of the novel construction of the upper plate there is required a disengagement connection between the upper plate and a lapping and polishing pad, which disengagement means consists of a rotatable bayonet structure.

There is also required in the present machine a structure for releasably locking the upper lap plate in an elevated position when it is disengaged from it's depending rotary support so as to provide unobstructed access to the center of the machine. This locking position of the upper lap plate is accomplished by interconnecting rings which receive pneumatic actuated locking pins. The positioning of the upper lap plate in a lockable position is indicated by a series of proximity switches as well as position indicating switches between the locking elements for the upper plate.

This invention also includes an automatic counterbalance control for the double wheel lapping machine. During the lapping process the laps wear and reduce their weights with the upper plate becoming lighter and lighter until pressure is insufficient to produce lapping or polishing results. This invention is provided with an automatic weight responsive pressure producing system to provide for uniform lapping and polishing operation. The mechanism also includes a single point automatic work piece thickness control to produce the proper wear action on the work piece by the lap plates.

The machine also provides a vertically positioned splash guard girding the lap plates so as to prevent centrifically generated slurry splashing during operation. An automatic lift-off transparent enclosure or shroud is provided to enclose the entire working area so as to trap and provide for exhaustion of dangerous gases produced during the machines operation.

The machine may include a computerized operational format including a menu providing for operational processing as well as maintenance and repair data as well as remote communications for specific requested information.

BRIEF DESCRIPTION OF DRAWINGS

The invention will be best understood by reference to the accompanying drawings which illustrate the preferred embodiment of the invention as well as the best mode for carrying out the objects of invention and in which.

Figure 1:
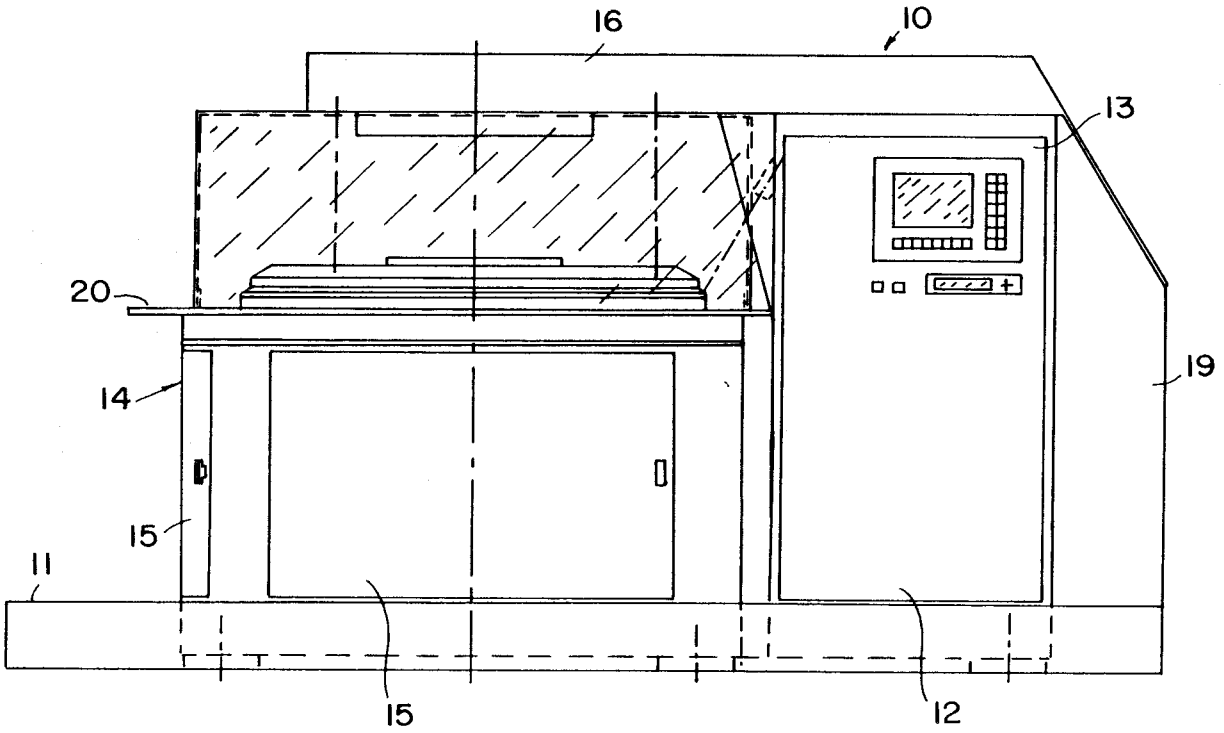
FIG. 1 is a side elevational view of the machine in it's operational mode.
Figure 2:
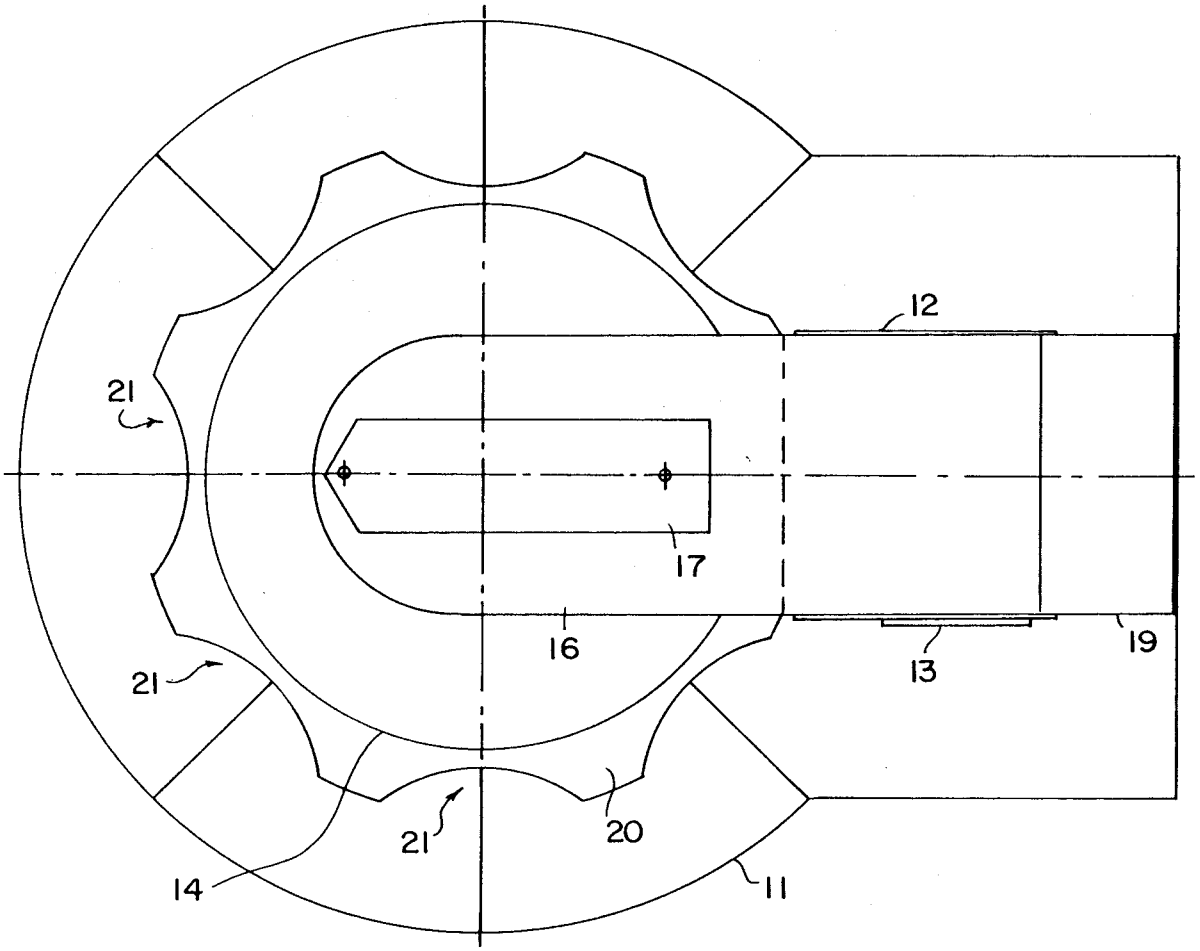
FIG. 2 is a top plan view of the machine.
Figure 3:
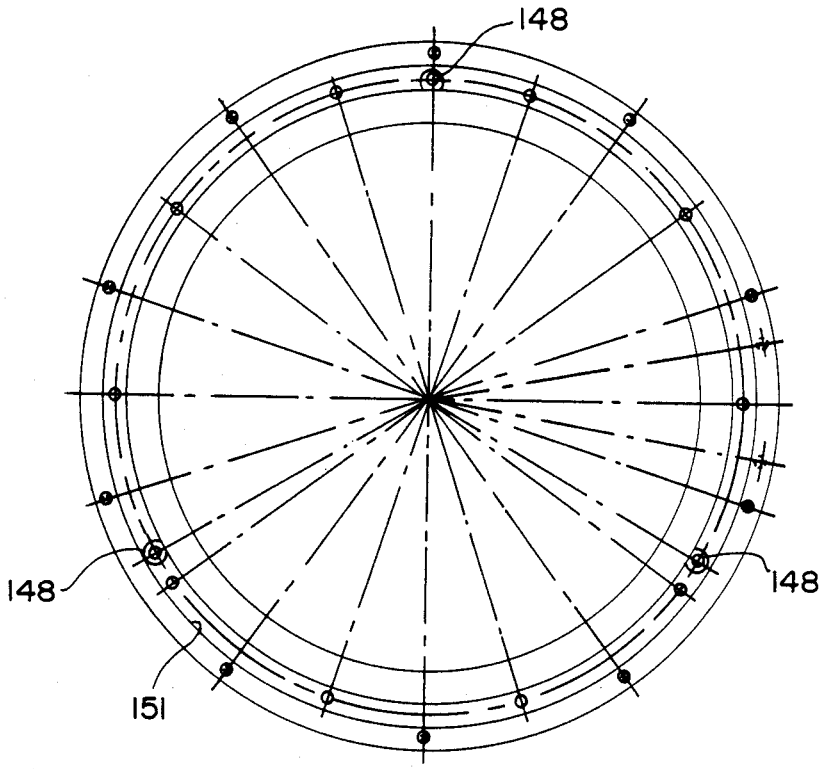
FIG. 3 is a top plan view of the upper lapping plate of the machine.

THE MACHINE'S AMBIENT STRUCTURE (FIGS. 1 and 2)

A new and novel as well as a more operative efficient machine design is illustrated in FIGS. 1 and 2, wherein a complete compact housing 10 is illustrated.

The compact housing 10 consists of a floor supported platform 11 and a intergal side cabinet 12 containing a control panel 13. A working base 14 is provided with a series of access doors 15 with the base 14 supported on the platform 11 to one side of the cabinet 12. A cantilevered arm 16 extends above and in spaced relation to the base 14, and is provided with a top access door 17.

As illustrated in FIG. 1 a transparent shroud (to be hereinafter more fully described) encloses the lapping and polishing work area of the machine 10. A partially walled storage area 19 is positioned to the opposite side of the cabinet 12 so as to provide a convenient out of the way storage area for the necessary replacement components for the machine.

Surrounding the platform 11 is a work apron 20 which provides a work table area in horizontal alignment with the operative lapping plates of the machine. As illustrated the periphery of the work apron 20 is periodically indented by semi-circular cut outs so as to provide a plurality of work stations 21 which by reason of their recess affords access to the entire interior of the working area of the machine. The housing 10 including the work apron 20 is manufactured from a durable soil and corrosion resistant plastic.

Planetary Pin Gear Drive for Lower Lap Plate (FIGS. 10–13)

In lapping and polishing machines of the character of this invention the normal rotary drive for a workpiece carrier consists of a planetary pin gear arrangement.

Figure 10:
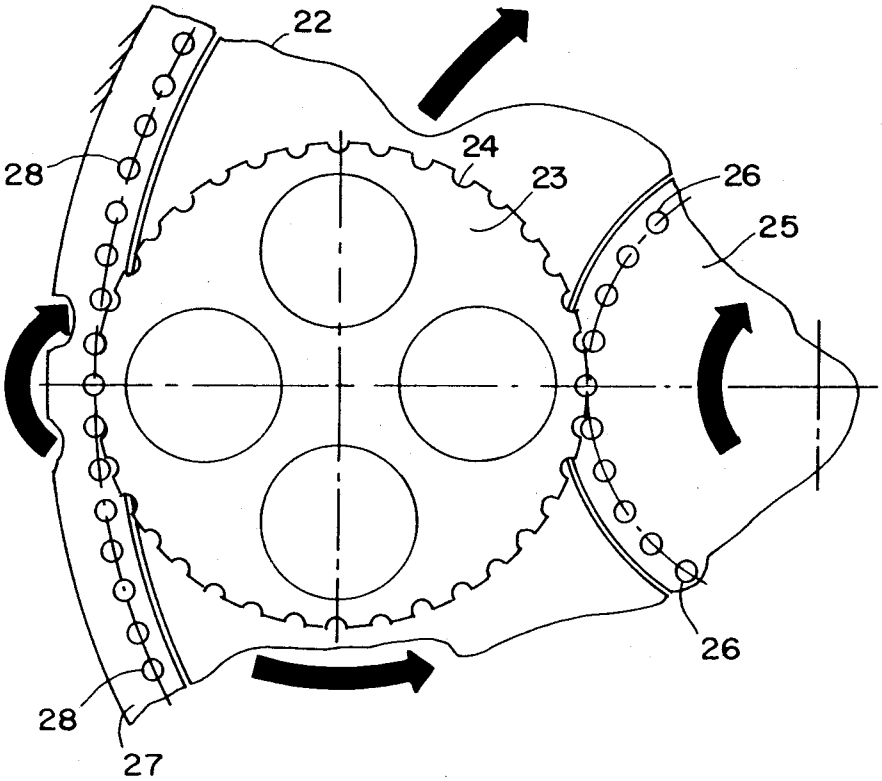
FIG. 10 is a fragmentary top plan view of the inner drive gear pin arrangement for the work carrier.

As shown in FIG. 10, the lower lap is partially shown as at 22, with the arrow indicating it's path of rotatable travel. A workpiece carrier 23 having a notched or toothed peripherial edge 24, is shown in facial abutment with the lower lap 22. An inner gear 25 illustrates it's series of drive pins 26 and their driving conforntation with the carrier 23. An outer gear ring 27 is partially illustrated with it's drive pins 28 in driving engagement with the toothed periphery 24 of the carrier 23. This is a graphic illustration of a normal planetary gear drive or machines of this character.

Figure 11:
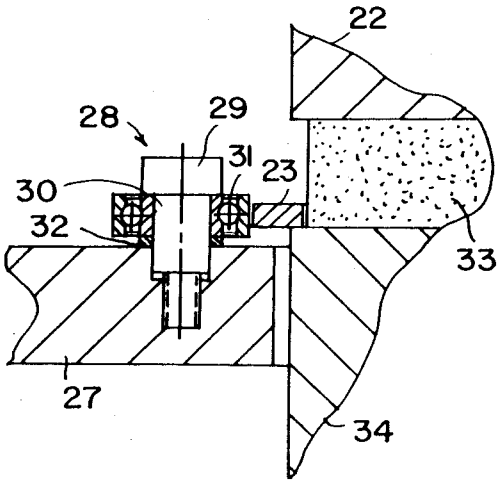
FIG. 11 is a fragmentary detailed sectional view of the outer drive pin utilized in this invention.

The first improvement in the pin gear drive of this invention is illustrated in FIG. 11, where it is shown that an outer gear ring 27 supports a series of outer gear drive pins 28. Each drive gear pin 28 consists of a headed bolt 29, the reduced shank portion 30 of which is adapted to be threaded into a tapped aperture formed in the ring 27. A ball bearing supported drive ring 31 is journalled on the bolt 29 between it's enlarged head and a retaining washer 32.

As fragmentarily shown in FIG. 11, the workpiece carrier 23 is shown as containing a work piece 33 positioned between the upper and lower lap plates 34 and 22 respectfully.

By providing each of the drive pins 28 with a freely rotatable drive ring 31, the successive driving contact between the notches on the periphery 24 of the carrier 23 is without frictional resistance due to the free rotation of the ring 31, thus prolonging the life expectancy of such meshing parts.

In prior machines of this character the drive pins were mounted in a stationary vertical relation to the lower lap plate 22. In such arrangement as the lower lap wore down from continuous lapping operation it would lower the horizontal positioning of the carrier 23 with respect to the drive pins until the carrier's peripheral edge would contact the pin supporting gear ring. To alleviate this objectionable result there is provided in this machine a convenient structure for adjusting both the inner and outer drive pins through a vertical plane relative to the rotating lapping plates.

Figure 12:
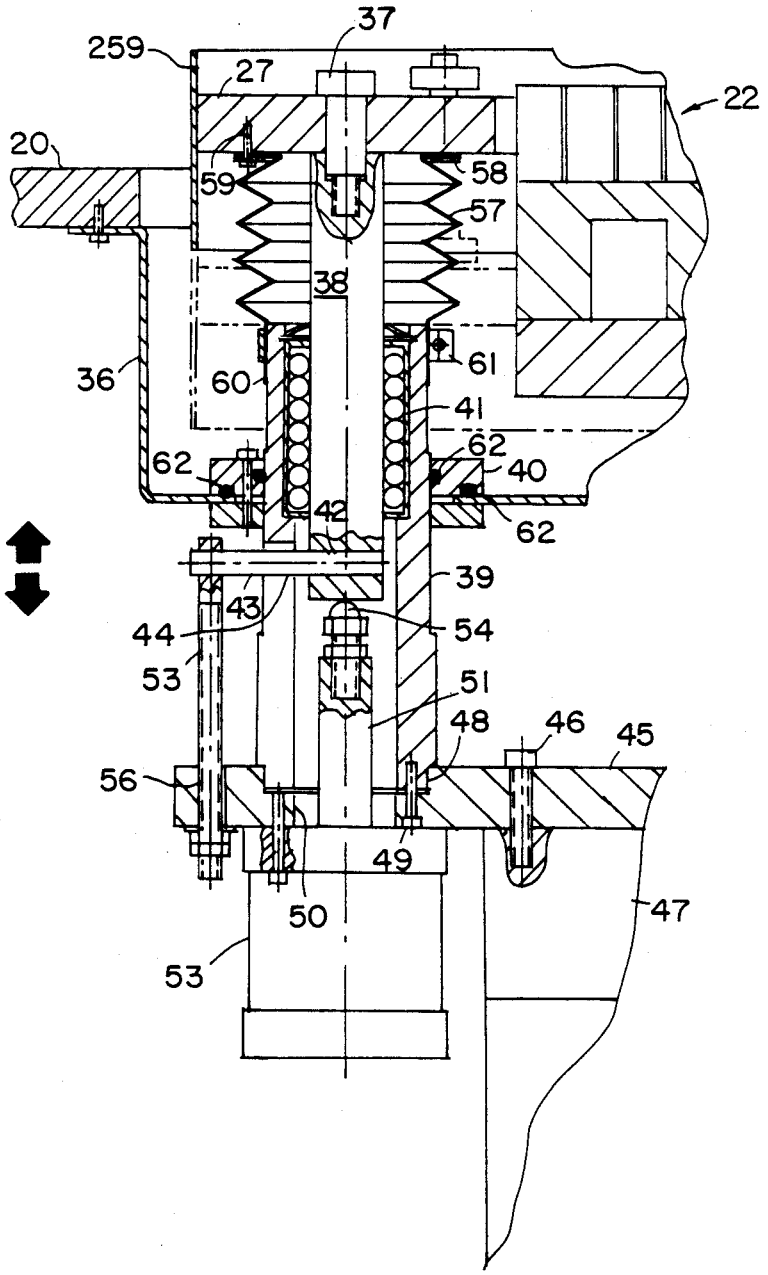
FIG. 12 is a fragmentary detailed sectional view of the outer drive pin gear height adjustment as employed in this invention.

FIG. 12 illustrates the structure by which the outer ring gear 27 is vertically adjusted relative to the lower lap 22. As illustrated a circular ringlike work table 25 mounted within the base 14 of the machine 10 supports a depending pan 36. The outer ring gear 27 by a series of bolts 37 are mounted upon a supporting shaft 38 which extends into a hollow sleevelike housing 39 that projects through an opening formed in the bottom run of the pan 36. By a mounting block unit 40 the sleevelike housing 39 is held in a fixed position relative to the pan 36. The supporting shaft 38 of the outer ring gear 27 is journalled through a linear bearing 41 contained in the sleevelike housing 39. Beyond the lower end of the linear bearing 41 the supporting shaft 38 has a transverse bore 42 which frictionally receives a horizontally extending connecting pin 43 the length of which is sufficient to place the free end thereof outwardly through a slot 44 formed in the lower wall section of the sleevelike housing 39.

A shelf 45 which by suitable bolts 46 is connected to an inner support structure 47 of the base 14 of the machine 10, provides a recessed seat 48 for the sleevelike housing 39. A suitable bolt 49 secures the housing 39 in a perpendicular relation to the shelf 45. An opening 50 in the shelf 45 communicates with the seat 48 and permits the projection therethrough of a piston 51 of a pneumatic cylinder 52. This cylinder 52 is mounted to the under side of the shaft 45 by a series of suitable bolts 53. The piston 51 provides an adjustable ball tip 54 which is adapted to engage the end wall of the supporting shaft 38, the purpose and function will be hereinafter described.

As shown the free end of the pin 43 is positioned in the head of an eye bolt 55 which extends coplanar to the axis of the shaft 38, through an opening 56 formed in the shelf 45 outwardly of the opening 50. By this arrangement with the pin 43 fixedly attached to the shaft 38 and connected to the eye bolt 55 the latter as it relates to the shelf 45 will assist in maintaining the shaft 38 in a vertical plane as it is caused to move vertically by the movement of the piston 51 through the operation of the cylinder 53. The nut on the end of the eye bolt 55 beneath the opening in the shaft 45, will also act as a stop against excess upward pressure of the piston 51 on the shaft 38.

As in normal practice there is an abrasive slurry supplied onto the lapping plate face to assist in its lapping operation, which slurry is recovered in the pan 36. In order to prevent the slurry from ingress into the linear bearing 41 a protective bellows 57 encases the exposed end of the shaft 38 and it's connection to the outer gear ring 27. As shown the bellows provides a flange 58 which by suitable bolts 59 are attached to the under side of the outer ring gear 27. The opposite end of the bellows 57 provides a skirt 60 which encircles the end of the sleevelike housing 39 and is fastened thereto by a suitable band clamp 61. It should also be noted that the mounting block 40 for the housing 39 is provided at suitable locations with "0" rings 62 so as to seal against leakage of the slurry onto the operative parts of the vertical adjustment mechanism.

Figure 13:
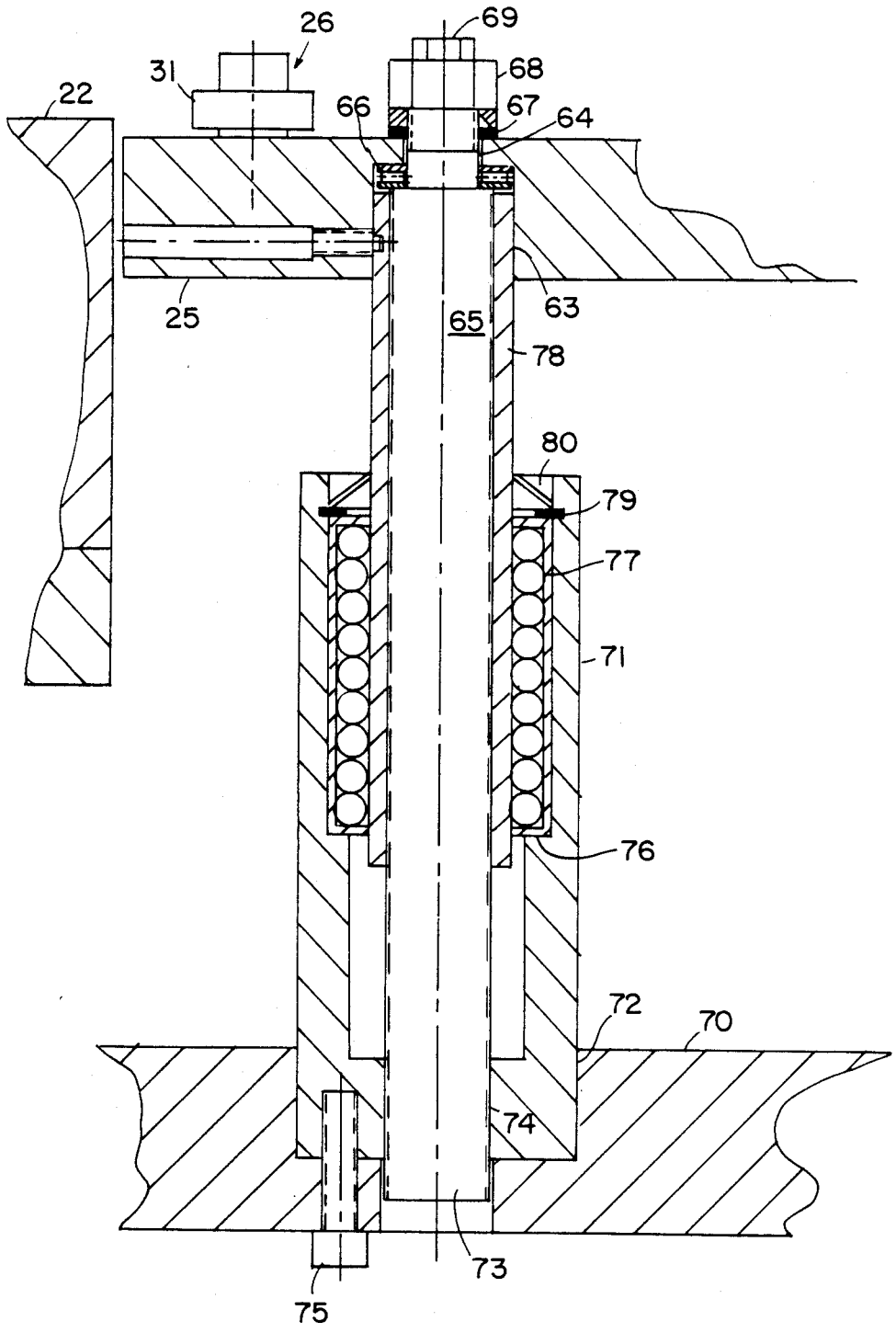
FIG. 13 is a fragmentary detailed sectional view of the inner drive pin gear height adjustment mechanism.
Figure 14:
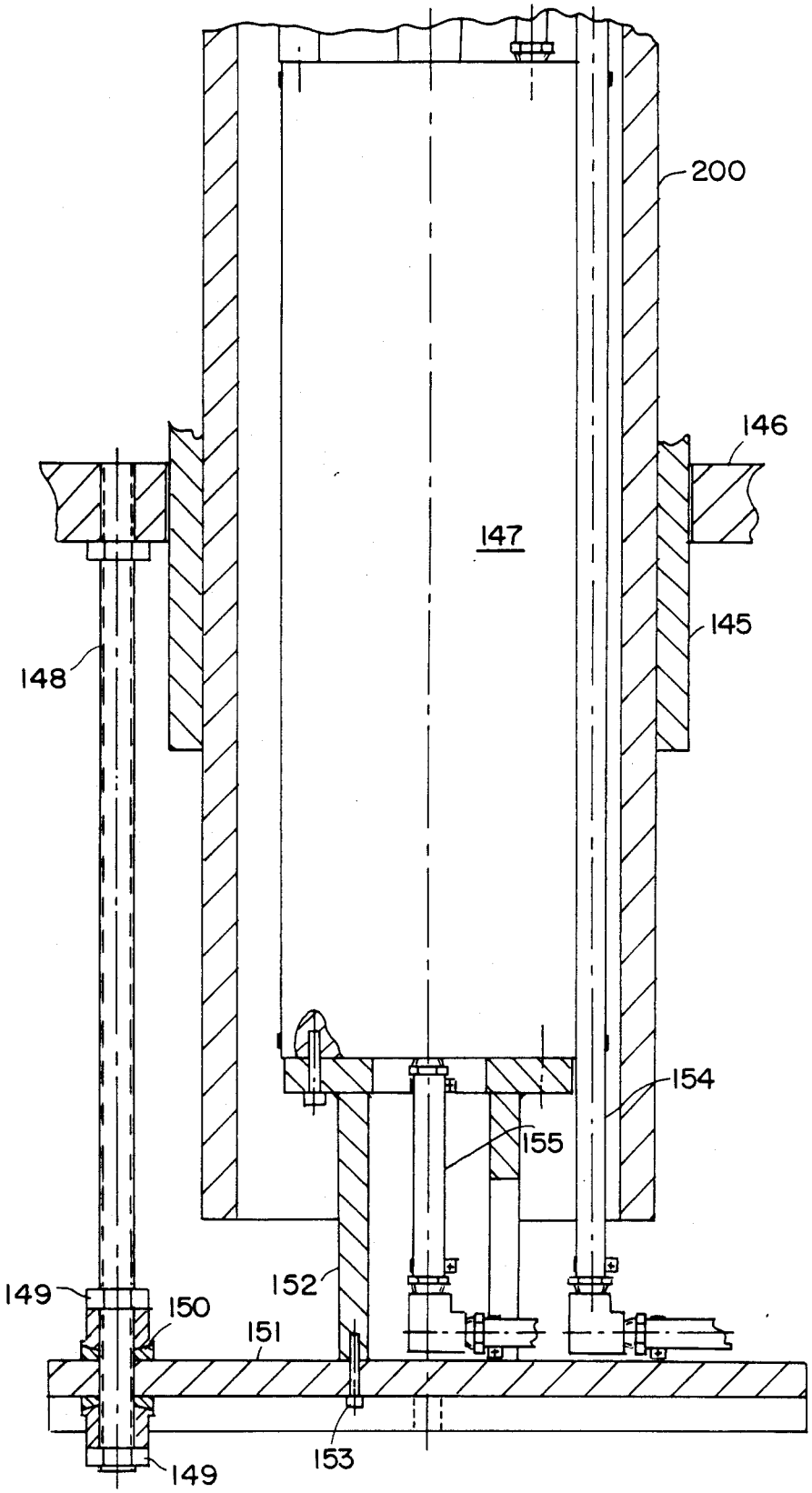
FIG. 14 is a fragmentary detailed sectional view of the pneumatic cylinder alignment system of this invention.
Figure 15:
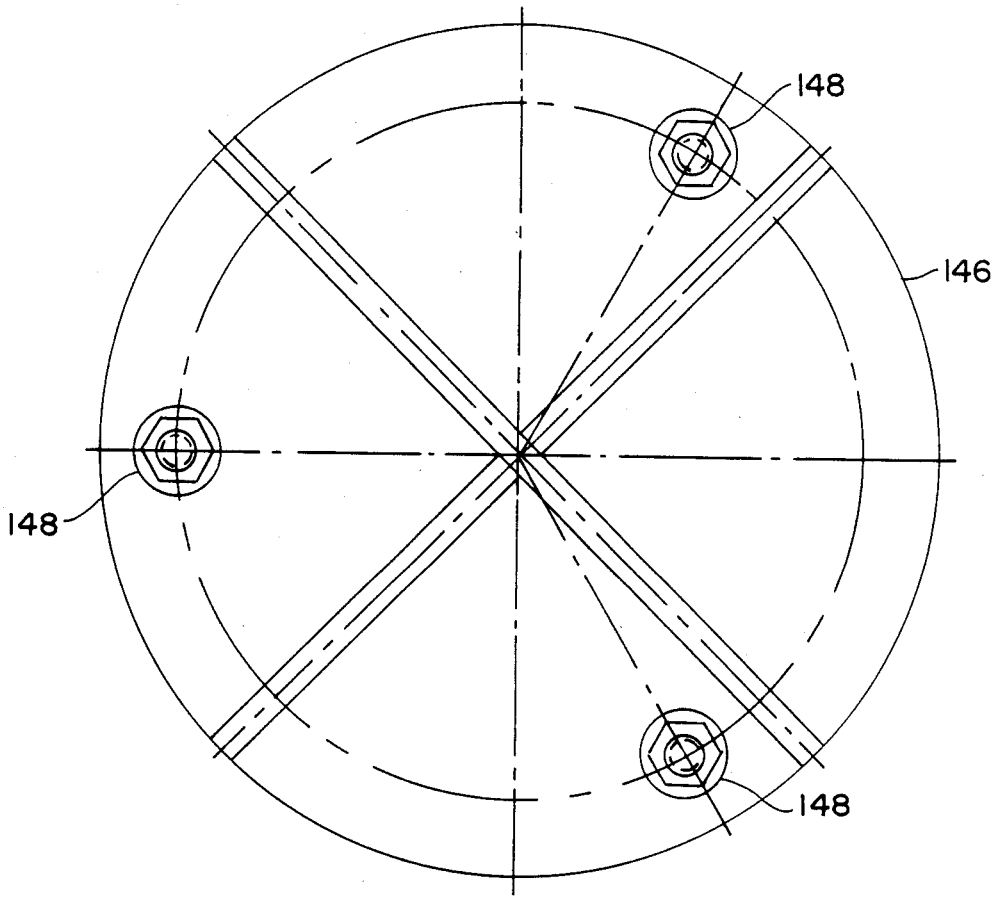
FIG. 15 is a top plan view showing the location of the adjustment shafts for the pneumatic cylinder of FIG. 14.

FIG. 13 illustrates the adjusting mechanism for the inner gear drive pins 26 as carried by the inner gear 25. Again it is important to note that the rotating ring 31 is desirous of being elevated in a relation to the upper face of the lower lap 22. To accomplish this the inner ring is provided with a bore 63 extending upward from the lower face of the inner gear ring 25, which bore 63 communicates with a countersunk passage 64 extending through the inner gear ring 25. An adjusting shaft 65 has one end positioned in the bore 63 and a reduced end projecting through and out of the passage 64. A thrust needle bearing 66 is positioned in the bore 63 upon the reduced shoulder of the shaft 65 while a suitable washer 67 embraces the reduced end of the shaft 65 and is held in sealing contact with the upper face of the inner gear ring 25 by a nut 68 threaded onto the shaft end 69.

Supported upon a fixed inner shelf 70 is a cup 71. As shown the base of the cup 71 projects into a seat 72 formed in the shelf 70. The base of the cup 71 has a circular tapped opening 73 formed in the bottom thereof which is adapted to be placed in alignment with a reduced opening 74 of the shelf 70 by a suitable bolt 75, the cup 71 is fixed to the shelf 70.

By an internal counterbore the inner wall of the cup 71 provides an internal shoulder 76 upon which sits a linear bearing 77, which bearing 77 engages the outer wall of an elongated sleeve 78. The bearing 77 is held in place by an internal sealing gasket 79 and a closure nut 80.

As shown the sleeve 78 freely embraces a substantial portion of the shaft 65, and has it's upper end projected into the openings 63 formed in the under side of the inner gear ring 25 and in operative relationship to the thrust needle bearing 66. By a halfdog set screw 81 carried by the inner gear 25 the sleeve 78 is fixedly attached to such gear.

When it is desired to adjust the horizontal plane of the gear ring 31 the operator can merely rotate the nut 68 thus threading the shaft 65 through the tapped opening 73 in the bottom of the cup 71 to physically move the sleeve 78 and the gear ring 25 through a vertical plane.

Figure 7:
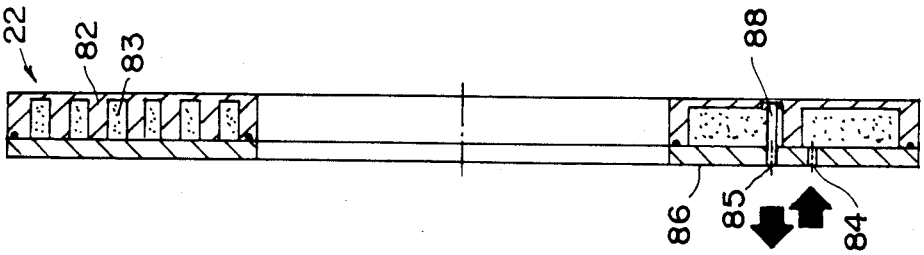
FIG. 7 is a side elevational sectional view illustrating the cooling channels for the lap plate of FIG. 6.
Figure 6:
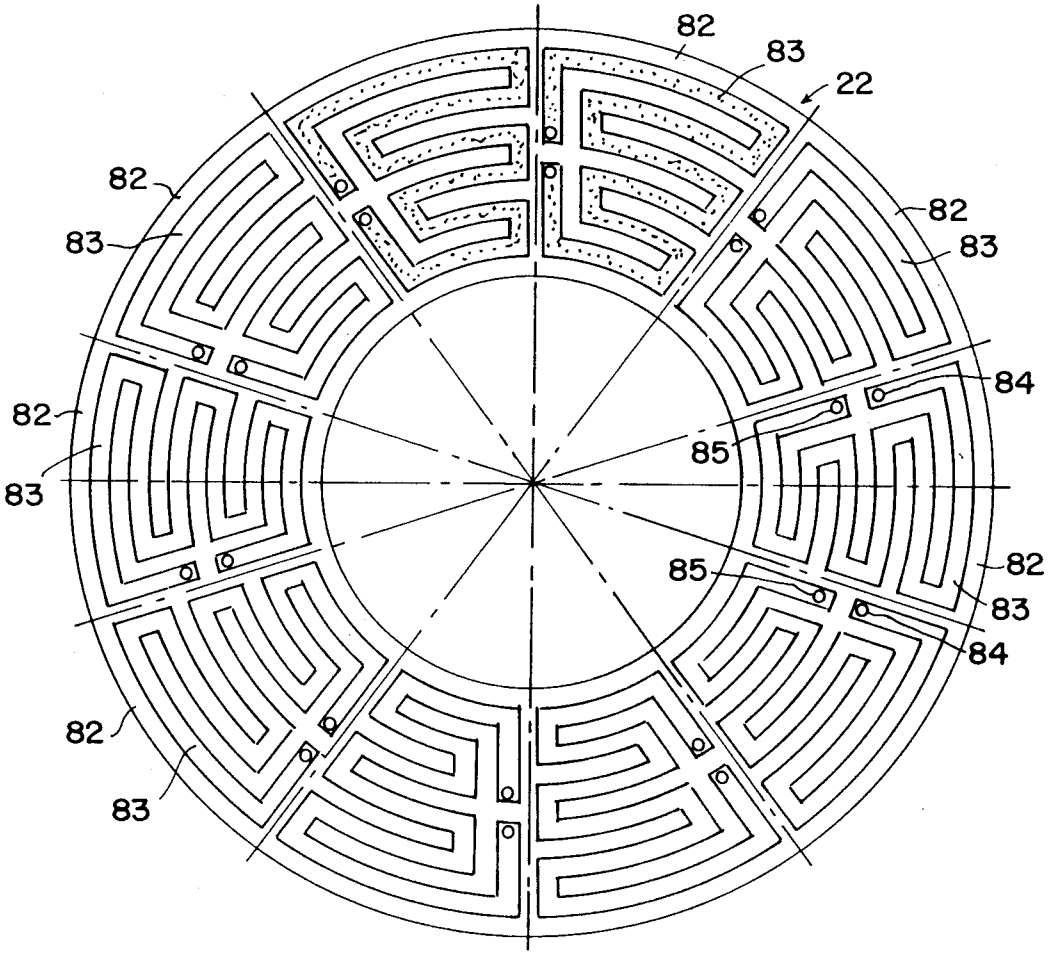
FIG. 6 is a top plan view of the multi-sector lapping plate utilized in this machine.

Lower Lap Plate Construction (FIGS. 6 & 7)

A multi-sector lower lap plate 22, with it's operative lap face removed is illustrated in FIG. 6. As shown each of the sectors 82 is provided with an individual fluid passage 83, with such passages 83 being continuous in a serpentine path between an inlet 84 and an outlet 85 provided by annular channels formed in the lap face 86 of the plate 22. The plate 86 is mounted on the lap plate 22 by a suitable adhesive after the fluid circulating systems are sealed against leakage by a set of "0" rings, as seen in FIG. 7. An overflow tube 87 extends through the outlet 85 and into a sunken well 88, and when the channels are filled the fluid will overflow out of the well 87 and outlet 85 to indicate such condition.

By this construction uneven distribution of a cooling liquid and the development of hot spots on the lap plate is eliminated. The coolant is delivered at a point midway of the width of the plate, and flows to it's outer edges, returning to the mid-point, before being exhusted. Thus the largest surface area of the plate is subject to the initial cooling effect of the fluid. By dividing the plate into sectors, and providing an overflow, which indicates an uninterrupted flow and full capacity of the coolant in the passages 83, it is assured that an even continuing distribution of the coolant is achieved.

Figure 4:
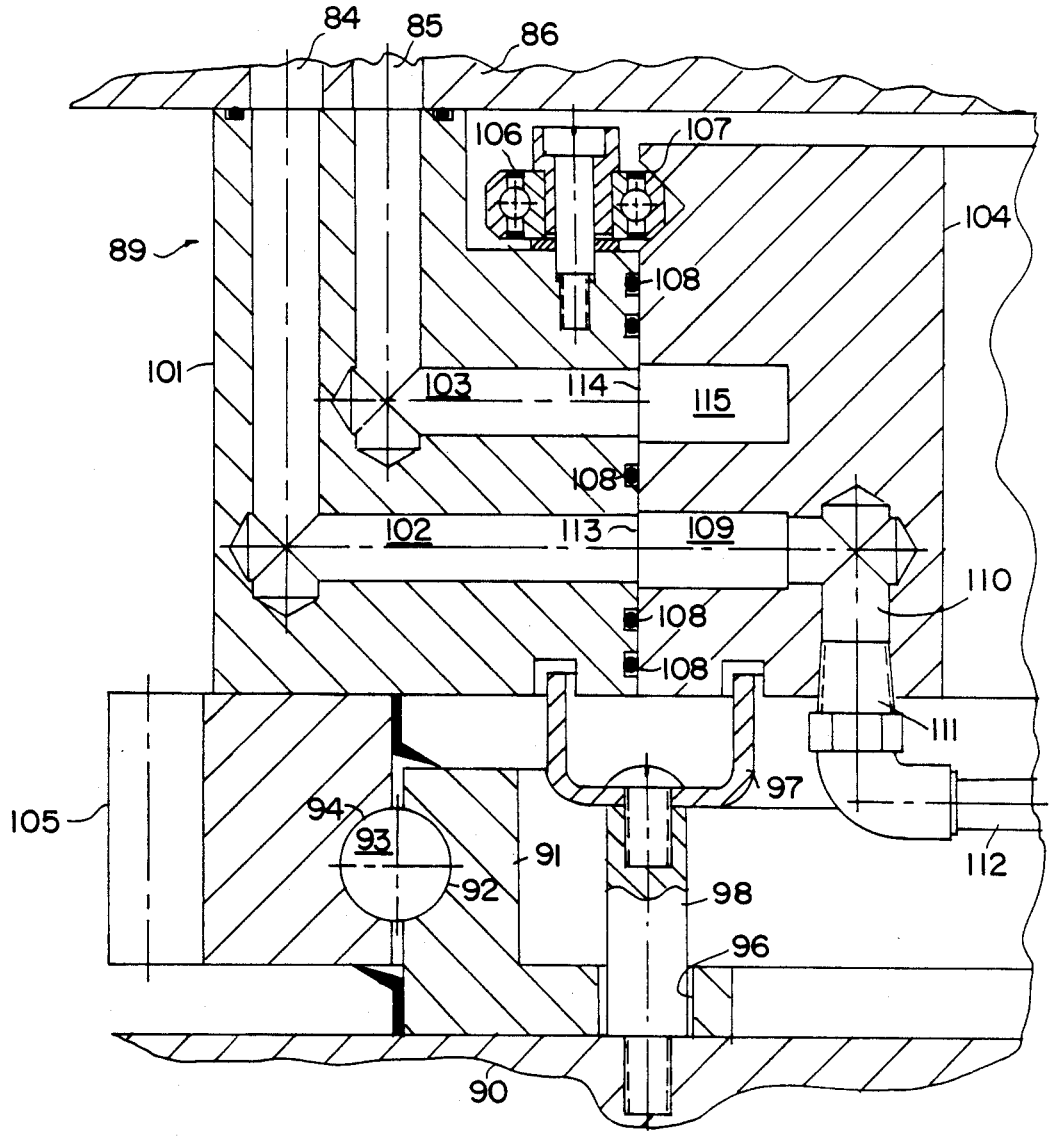
FIG. 4 is a fragmentary detailed sectional view of the rotary union for the drive connection of the lower lap plate.
Figure 5:
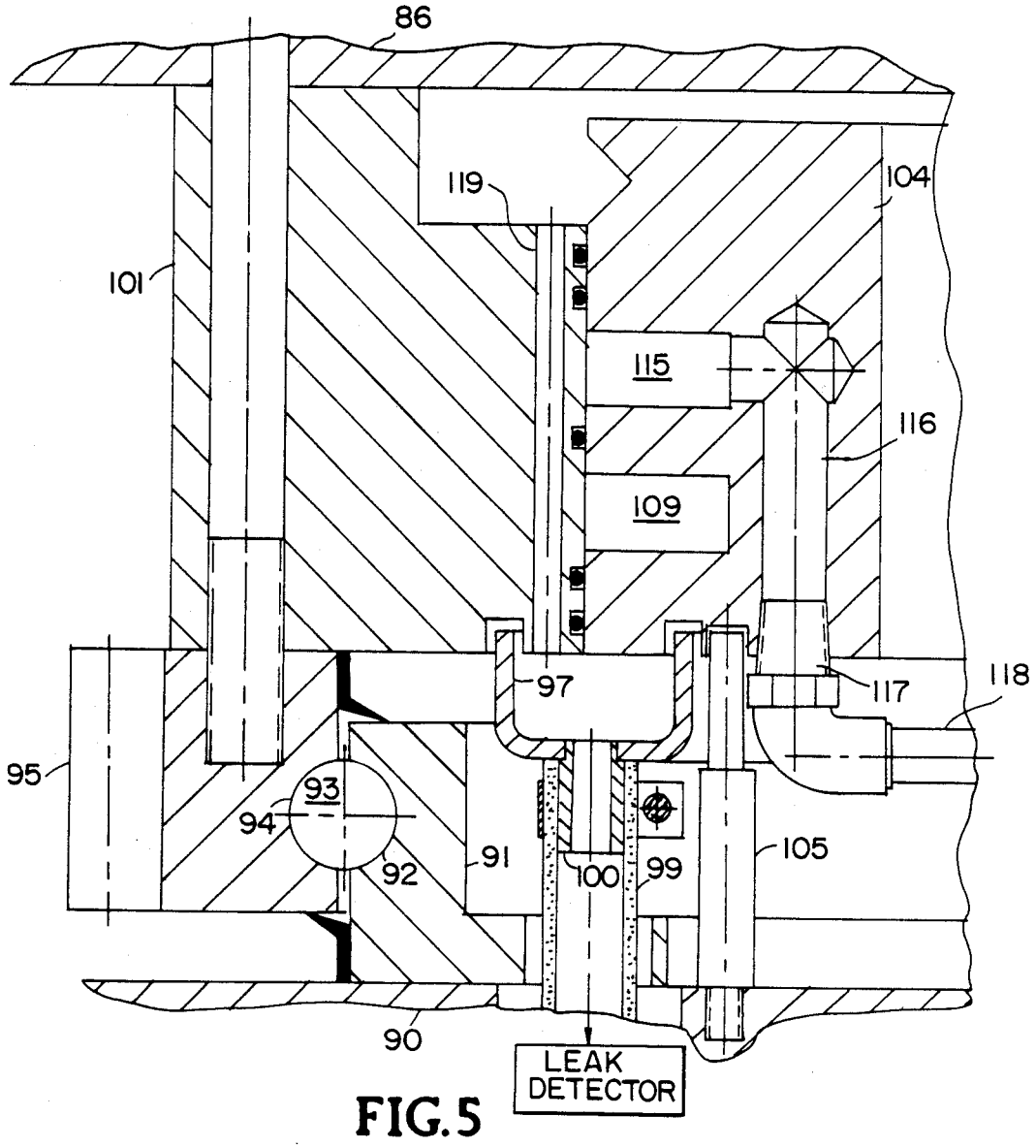
FIG. 5 is a fragmentary detailed view of the rotary union, similar to FIG. 4 and illustrating a leakage drainage system for the same.

Rotary Union (FIGS. 4 & 5)

To facilitate the continuous supply and circulation of the coolant during the rotation of the lap plate 22 a rotary union 89 is provided.

This rotary union 89 is illustrated in FIGS. 4 and 5, wherein the intake and exhaust systems are shown in detail.

Referring to FIG. 4 there is shown a support 90 for a fixed hub 91. This hub 91 provides a raceway 92 for suitable ball bearings 93, which in turn are seated in a confronting raceway 94 of a driven gear wheel 95. The base of the hub 91 is provided with a anular open channel 96. A fluid receiving ring-like pan 97 is supported within the hub 91 by suitable studs 98 periodically projecting upwardly from the support 90, through the channel 96, with the studs 98 then fastened to the pan 97 by suitable bolts or the like as shown.

At one point a tubing 99 is extended through an opening in the support 90 and projected through the channel 96 an onto an exhaust nipple 100 which depends from and has open communication with the pan 97. The end of the tubing 99 is sealed to the nipple 100 by a suitable band clamp, as shown in FIG. 5.

Mounted upon the driven gear wheel 95 is a rotary ring 101, which in turn is secured by any suitable manner to the base plate 86 of the lower lap plate 22. Bored in the rotary ring 101 is an inlet passage 102 and an exhaust passage 103, each of these passages have continuous open communication respectively with the annular inlet 84 and outlet 85 formed in the base plate 86 of the lower lap plate 22.

Within the rotary ring 101 is a center ring 104 held stationary by a stepped standoff 105 extending between it and the support 90. A suitable bearing ring unit 106 is carried by the rotary ring 101 and cooperates with a bearing racewary 107 formed in the wall of the stationary center ring 104. Between the confronting edges of the rotary ring 101 and the stationary center ring 104 are a series of sealing gaskets 108.

Formed throughout the periphery of the stationary center ring 104 is a fluid distribution chamber 109 which has open communication with an intake passage 110, that in turn extends through the bottom of the center ring 104 and readily receives an inlet nozzle 111 connected to a fluid intake tube 112.

Figure 43:
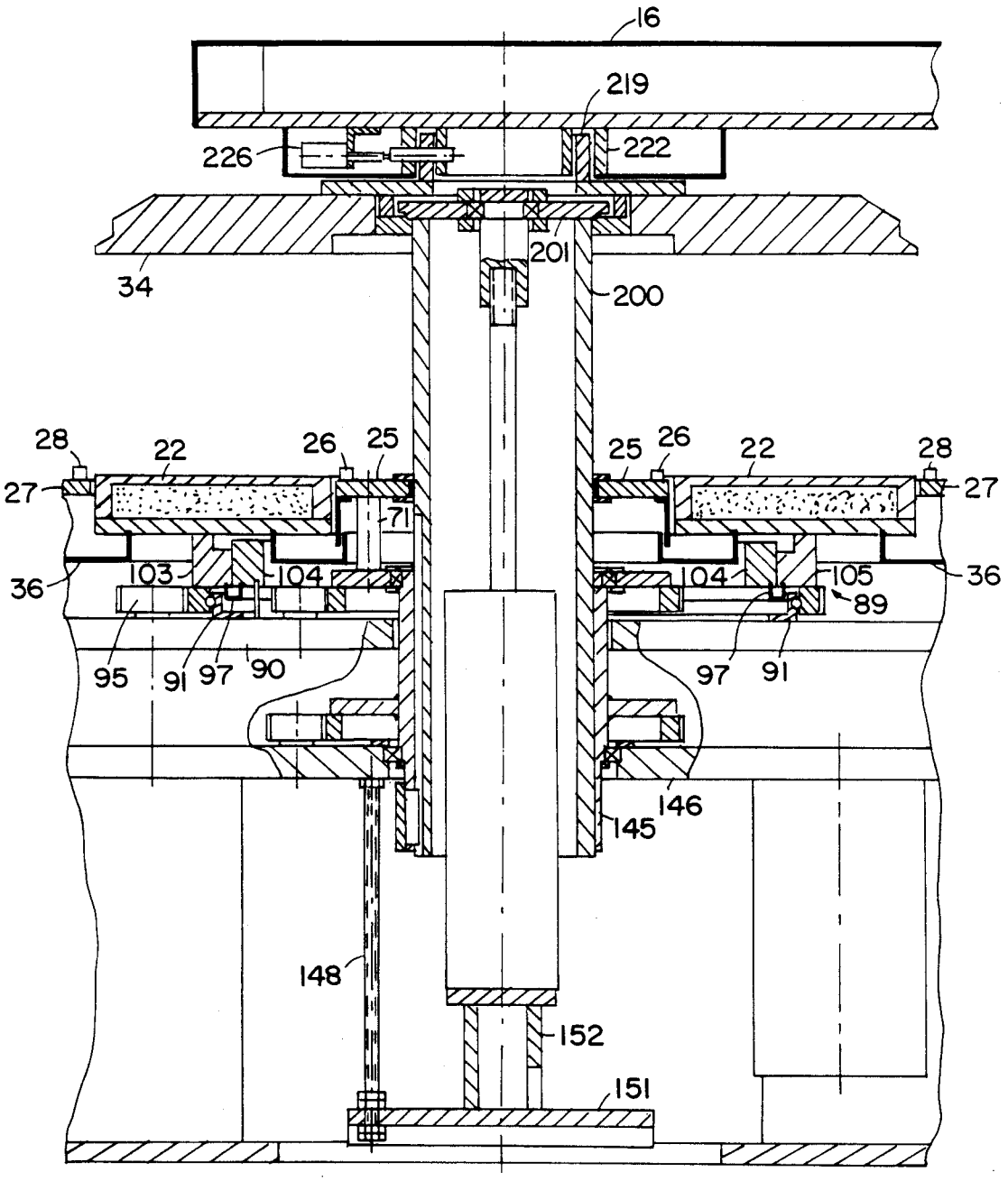
FIG. 43 is a fragmentary sectional detailed view showing the operative parts of the machine with the upper lapping plate in a elevated position.

Thus as the driven gear wheel 95 is caused to rotate, by a chain of gears driven by a power source such as an electric motor, all of which are schematically shown in FIG. 43, and are of a common structure in the art, the wheel 95 will in turn rotate the rotary ring 101, which in turn rotates the lower lap plate 22.

At all times during the rotation of the parts above identified, the open end 113 of the inlet tube 102 formed in the rotary ring 101 will be in open communication with the annularly formed distribution chamber 109.

As depicted in FIGS. 4 and 5, the return or exhaust passage 103, formed in the rotating ring 101, will have it's open end 114 in continuous communication with an annular exhaust channel 115 formed in the peripheral wall of the stationary center ring 104. As shown in FIG. 5 this exhaust channel 115, through a suitable boring 116 that extends through the bottom of the stationary ring 104, receives an exhaust nipple 117 that in turn communicates with an exhaust tube 118.

By this structural arrangement a coolant is continuously supplied through the rotary union to the lower lap plate 22 during it's operational rotation.

A liquid detector passage 119 is formed throughout the rotating ring 101 between the area of the bearing raceway 107 and the fluid receiving pan 97. Thus any liquid leaking into this area will collect in the pan 97 and be free to be dispensed through the tube 99 and beyond, to be detected by a suitable responsive switch, not shown but of the type well known in the art, which in turn will electrically produce a warning either by illuminating a light on the control panel 13 or emitting an audio signal to alert the operator of the defect.

By preventing continuous leakage or accumulation of fluids between the rotating parts of the union, such parts are prevented from being rendered inoperative. The early leakage detection will afford the operator of the machine time in which to disrupt it's operation and readily affect the necessary repair. Through this structural arrangement the operator is made immediately aware of the location of the developing trouble spot thus reducing the down time of the entire machine.

SLURRY DELIVERY SYSTEM (FIGS. 27–37)

Figure 28:
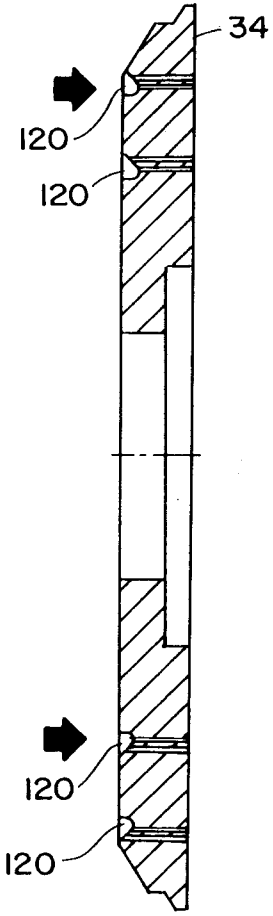
FIG. 28 is a side elevational detailed sectional view of the upper lap plate as shown in FIG. 27.
Figure 27:
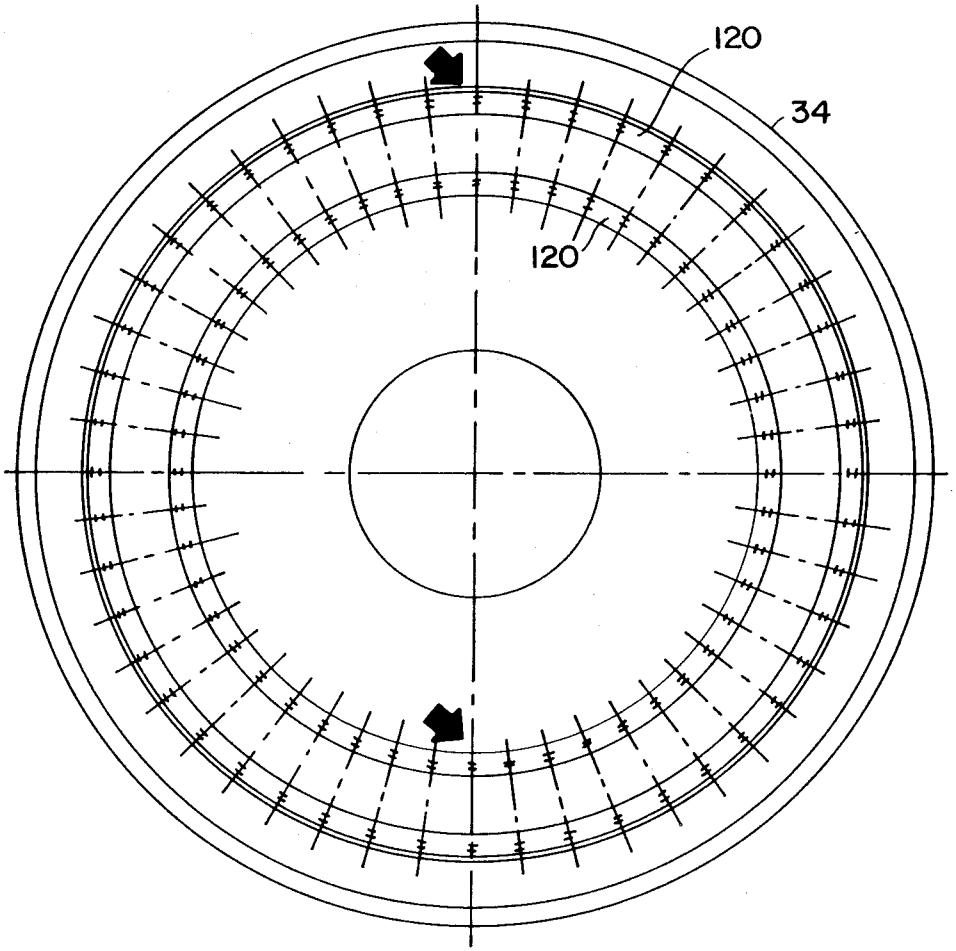
FIG. 27 is a top plan view of the upper lap plate showing the receiving openings for the polishing and lapping slurry used in the operation of the machine.

One object of this invention is to provide a slurry delivery system wherein the slurry is uniformly dispensed without loss or overflow. To achieve this object there is provided a specially designed upper lapping or polishing plate 34 as illustrated in FIGS. 27 and 28.

Figure 33:
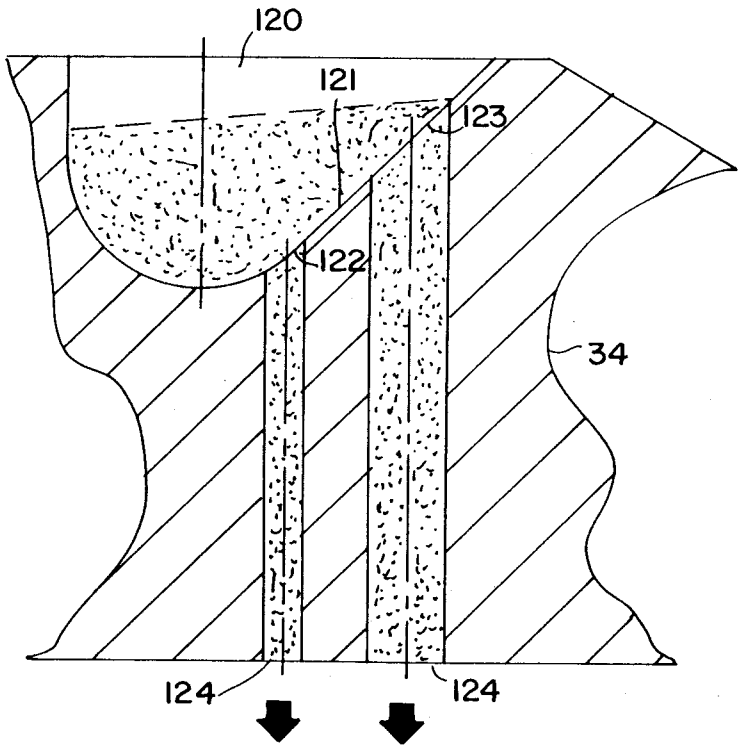
FIG. 33 is an enlarged fragmentary detailed sectional view similar to FIG. 32 showing the slurry receiving channels in full capacity.
Figure 32:
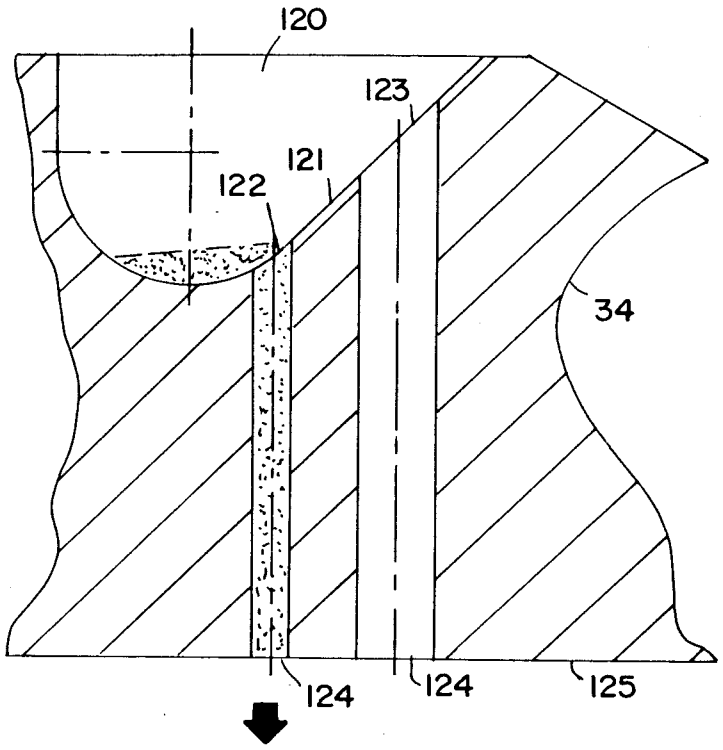
FIG. 32 is an enlarged fragmentary detailed sectional view showing the slurry receiving channels of the upper plate in partially filled condition.
Figure 35:
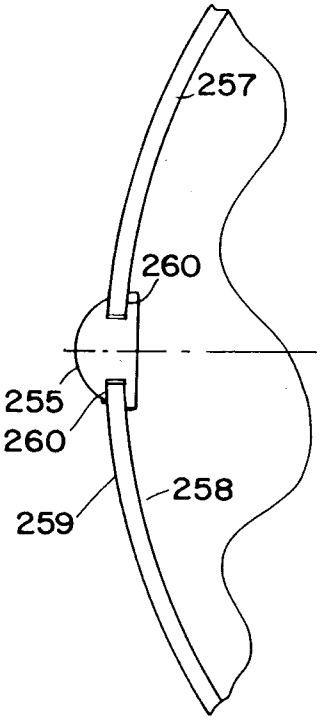
FIG. 35 is a top plan view of a connector between the segmented portions of the splash guard.
Figure 34:
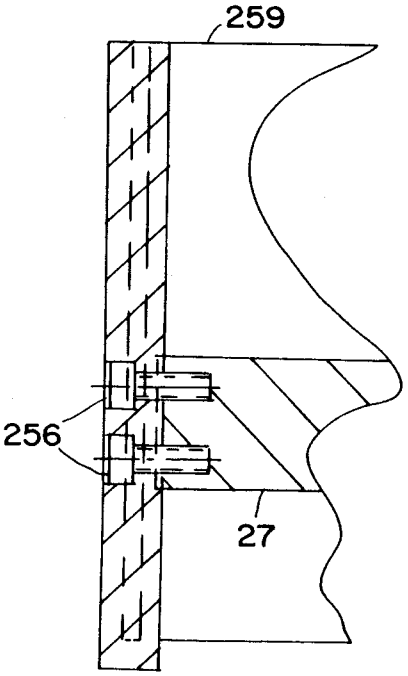
FIG. 34 is a fragmentary detailed sectional view showing the method of attaching the splash guard to the work table of the invention.

The face of the plate 34 has formed therein a pair of spaced apart concentric channels 120. As illustrated and more clearly shown in FIGS. 32 and 33 each of the channels 120 are deformed so as to provide a large sloping or inclined side wall 121 in which a pair of different size openings 122 and 123 are formed, with each opening communicating with an exhaust passage 124.

The slurry, as delivered by a delivery system to be hereinafter described, initially accumulates at the bottom of the channels 120, and as the channels fill the slurry will then cascade through the small holes 122 simultaneously throughout the face of the plate 34. As the slurry flow increases the surplus will accumulate in the channels 120 above the small openings 122 until it rises in the channels where it then will cascade through the larger holes 123, as clearly illustrated in FIG. 33.

The slurry fluid as it immerges from the exhaust passages 124 is centrifically dispensed beneath the lower surface 125 of the rotating lap 34 in the area occupied by the workpieces 33. The workpieces 33 may be retained in a workpiece carrier and be situated between the operative surface 119 of the upper lap 34 and the complementary operating surface of the lower lap 22.

Figure 29:
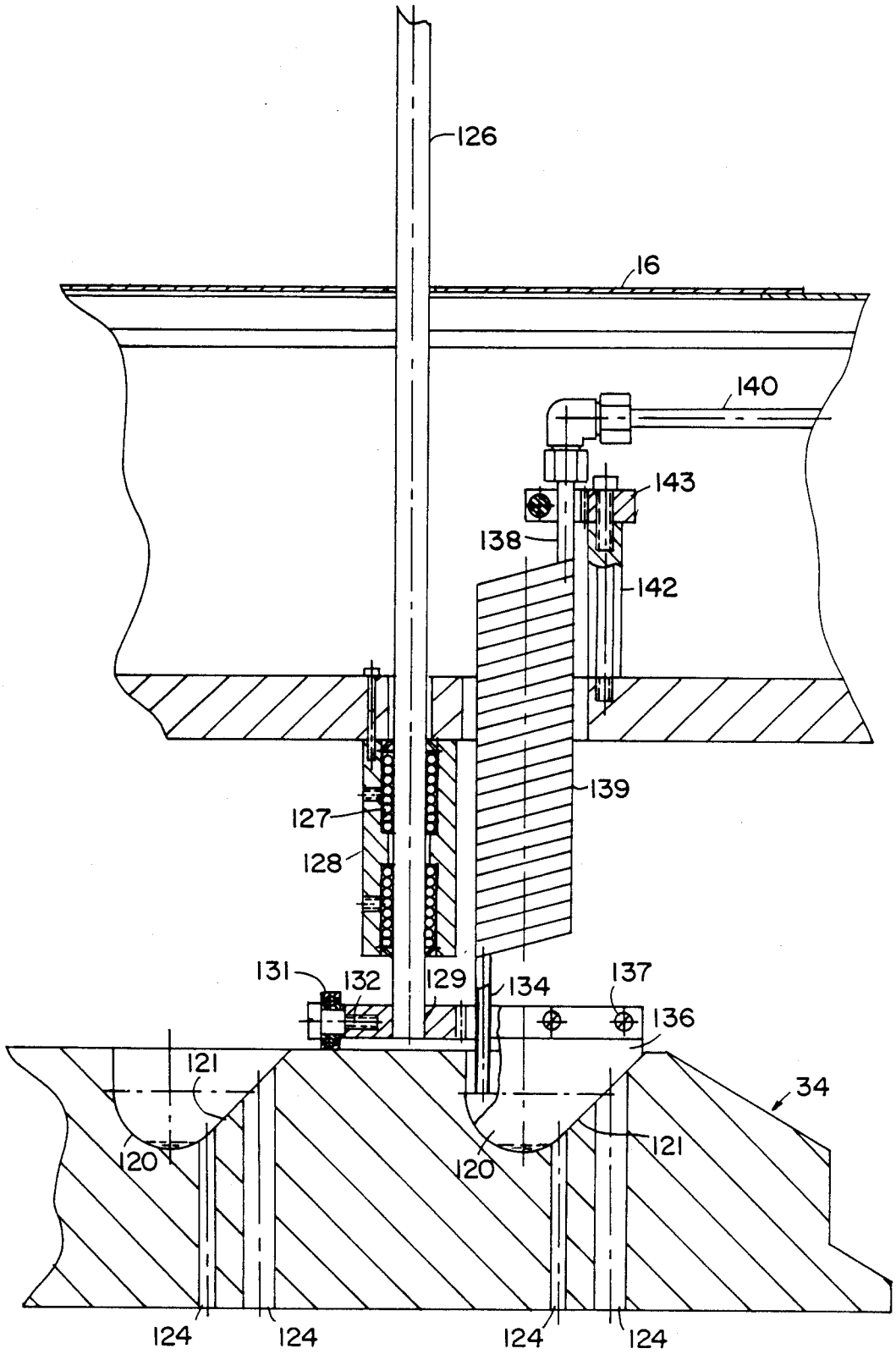
FIG. 29 is a fragmentary detailed sectional view of the slurry delivery system for use with the upper plate as shown in FIG. 27.

As shown in FIG. 29 a slurry supply system consists of a vertical support rod 126, slidably mounted in a suitable bearing 127, attached by suitable fasteners 128 to the under side of the cantilevered arm 16 of the machine.

Figure 30:
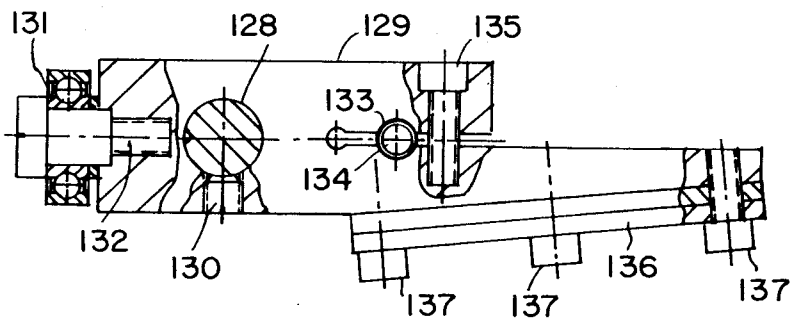
FIG. 30 is a fragmentary detailed sectional view of the lower connecting and positioning mechanism for the slurry delivery system as shown in FIG. 29.

At the free lower end of the rod 126 is a bracket 129 attached by set screws 130 as shown in FIG. 30. The bracket 129 provides at one end a roller 131 mounted upon a connecting shaft 132 which in turn is threaded in one end of the bracket 129. The opposite end of the bracket 129 is of a split formation so as to provide a passage 133 for the reception of a dispensing tube 134. The tube 134 is secured in the passage 133 by screw 135. A wiper plate 136 is mounted by screws 137 to the under side of the bracket 129, with the wiper plate 136 having a free edge configurated so as to conform to that of the annular channels 120 such that it can be readily positioned therein.

During rotation of the upper lap plate 34 the wiper plate 136, positioned in the channels 120 will distribute the slurry therein evenly throughout such channels. The wiper plate 136 continuously agitates the slurry preventing accumulation of particles at the bottom of each of the channels 120 thus preventing any particle build up in the channels or the openings 122 and 123 formed therein.

Figure 31:
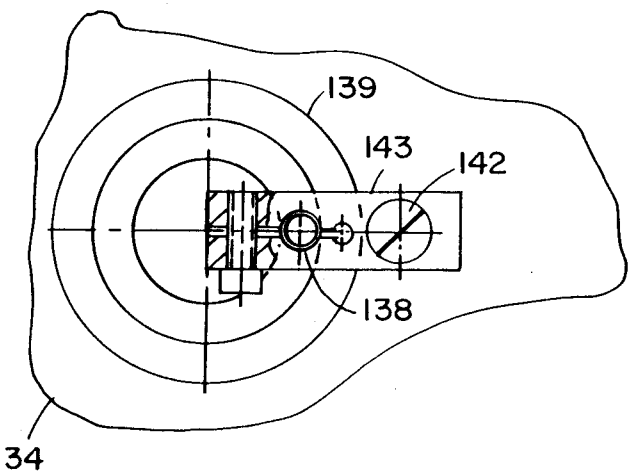
FIG. 31 is a fragmentary detailed sectional view showing the mounting connection for the slurry delivery system as shown in FIG. 29.

As shown in FIG. 31 a dispensing tube 138 is connected to one end of a spirally coiled reservoir 139, which in turn, by an access tube 140, is in communication with a slurry supply tube. The upper end of the spirally curved reservoir 139 is supported by a rod 142 mounted within the cantilevered arm 16 of the machine 10. Attached to the upper end of the rod 142 is a split housing 143 which embraces and supports in a fixed position the tube 140 of the slurry supply system.

It should be noted that the sprirally coiled reservoir 139 is made from a flexible material so that it, as well as the supporting rod 126, may readily adjust to the various elevated positions of the upper plate 34 during it's operative and inoperative positioning relative to the lower lapping plate 22.

PNEUMATIC CYLINDER ALIGNING AND POSITIONING MEANS (FIGS. 14 & 15)

The upper plate 34 of the present machine is supported from it's under side by a vertically extending quill 200 which is adapted to be restrictively moved vertically through the center of the lower plate 22 into an operative position where it's lap face will be in contact with the workpieces 33 placed upon the lower lap plate 22, or in an inoperative position where it is elevated from the lower lap plate 22 and positioned immediately below the cantilevered arm 16 of the machine.

It is important to maintain the proper vertical alignment of the quill 200 and thus the positioning of the upper plate 34 either in it's operative or inoperative position. To accomplish such vertical alignment the quill 200 is positioned within a fixed sleeve 145 that projects through a stationary mounting flange 146 provided within the interior of the machine base. To vertically position the quill 200 a pneumatic cylinder 147 is positioned within the quill 200. Three equally distant threaded rods 148 depend from the mounting flange 146 and each rod is provided at it's lower threaded end with a pair of retaining nuts 149 which have interposed therebetween a bearing structure 150 that in turn supports a base member 151. The cylinder 147 is provided with a hollow supporting stem 152 which by a series of fasteners 153 are secured to the base of the cylinder 147 to mount the same to the base 151. The cylinder 147 is provided with suitable flexible inlet 154 and exhaust tubing 155.

STRUCTURE FOR DISENGAGEMENT OF POLISHING PAD FROM LAP PLATE (FIG. 17 & 18)

The following described structure provides unobstructed access to the center of the machine by providing complete clearance between the upper and lower lapping plates in order to facilitate changing the polishing pads and/or lapping plates or to perform necessary repairs and maintenance.

Figure 17:
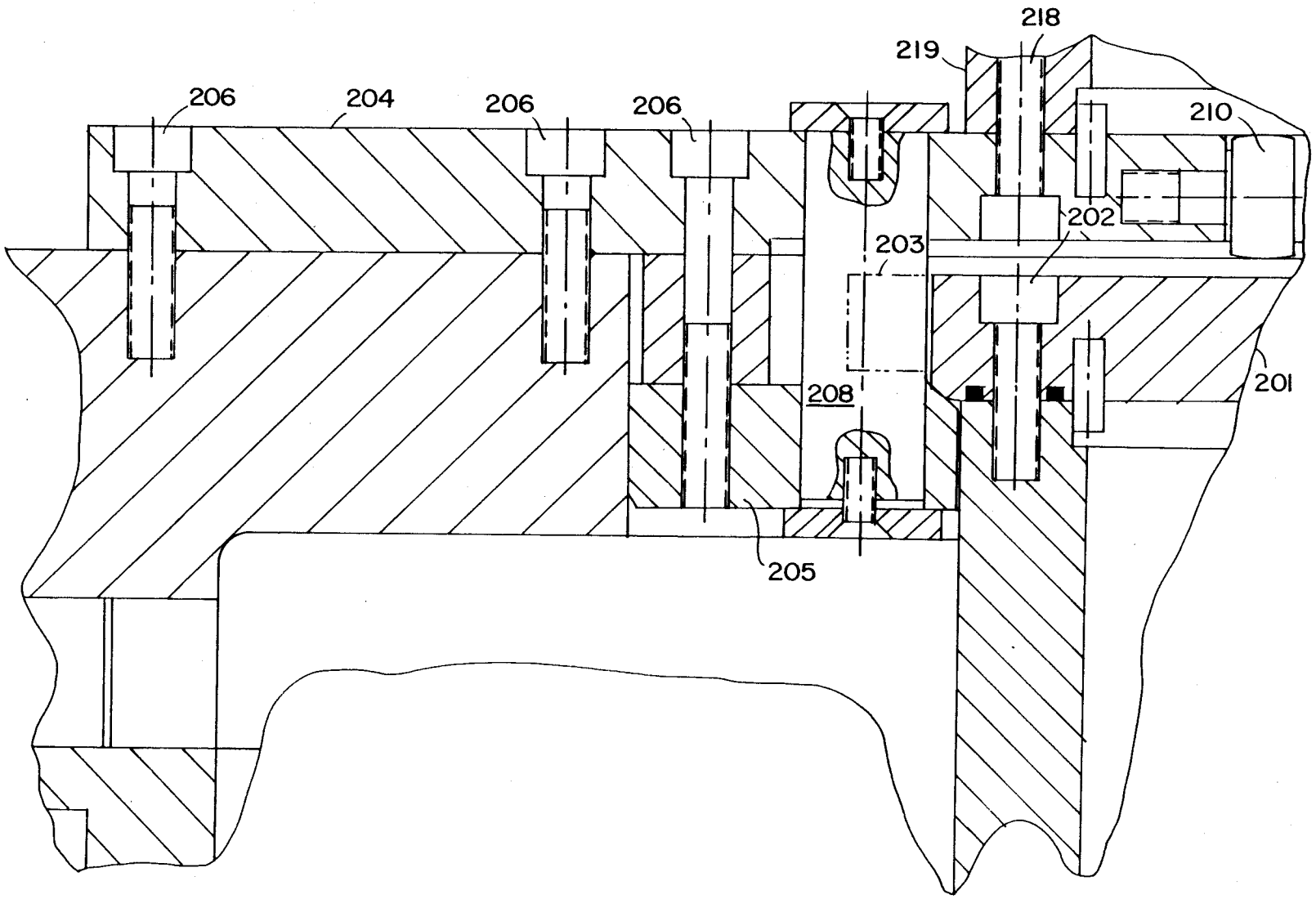
FIG. 17 is a fragmentary detailed sectional view of the drive pin engagement between the upper lap plate of the machine and it's rotating drive.

As illustrated in FIG. 17 the centrally located rotating quill 200 is topped with a male portion of a bayonet plate 201. As illustrated the bayonet plate 201 is removably attached to the end of the quill 200 by fasteners 202.

The bayonet plate 201 consists of a flat rounded plate having a series of driving teeth 203 protruding radially from it's round profile.

The female portion of the bayonet connection is a sandwich of two circular plates 204 and 205 with the plate 204 overlapping the bayonet plate 201 while the plate 205 which is ring-like in constructions, lies beyond the periphery of the bayonet plate 201. By a series of fasteners 206 and a spacer 207 the plates 204 and 205 are joined together and connected to the upper lap 34.

Extending between the plates 204 and 205 are a number of drive pins 208, which are adapted to lie in the path of the teeth 203 extending radially from the bayonet plate 201. By this arrangement a rotatable drive is established between the quill 200 and the upper lap plate 34.

Figure 18:
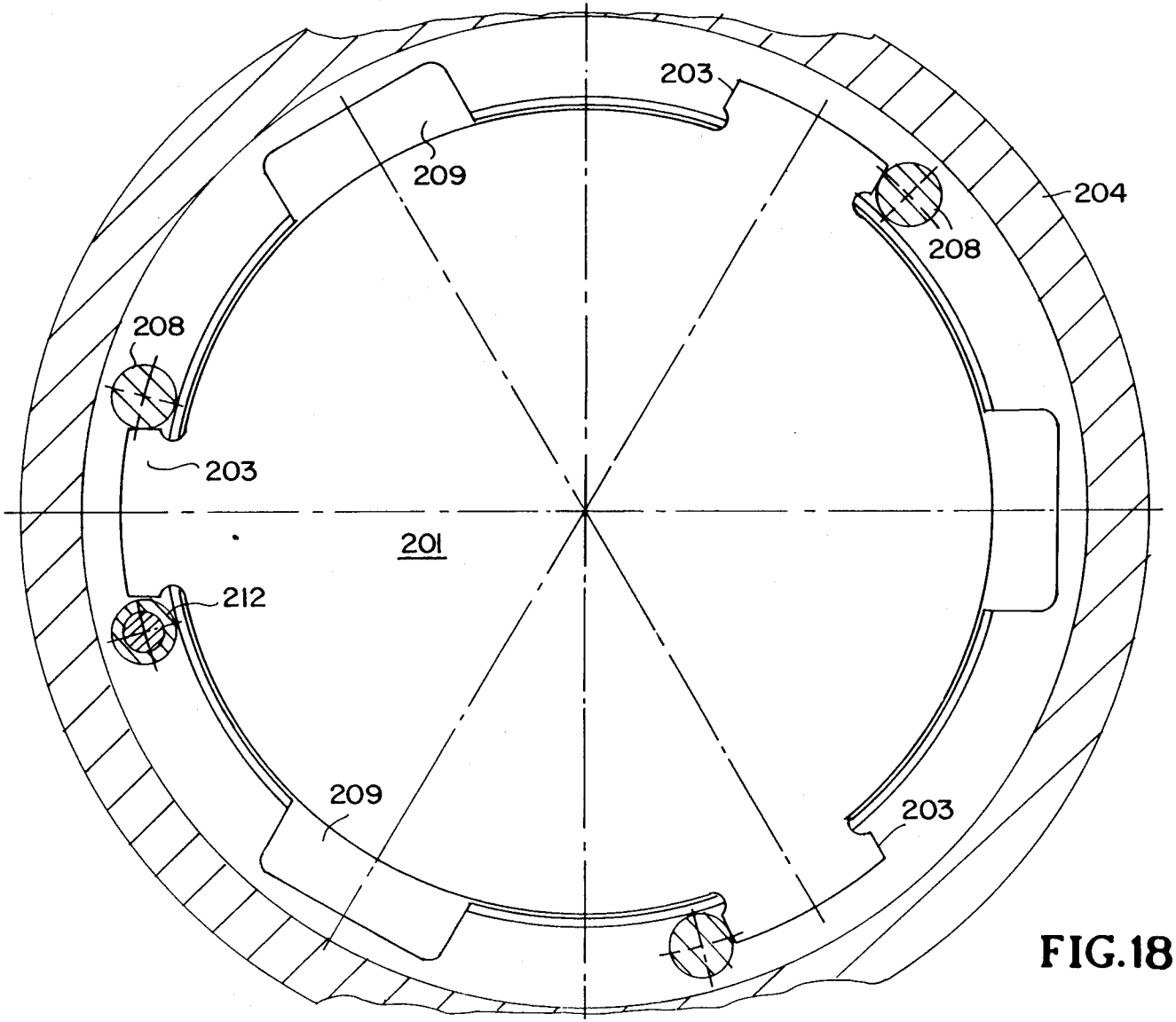
FIG. 18 is a fragmentary top plan view of the disengagable drive pin arrangement for the upper lap plate.

FIG. 18 illustrates the removable connection between the bayonet plate 201 and the plates 204 and 205 of the female portion of the bayonet connection, and in turn the upper lap plate. This arrangement provides for a series of openings 209 to be formed in the lower plate 205. These openings 209 are of size to accommodate the teeth 203 so as to allow the same to penetrate the space between the plates 204 and 205. When the teeth are projected through the openings 209 and into the space between the overlapping edges of plates 204 and 205, the latter together with the lap, are rotated counterclockwise, as shown in FIG. 18, until they engage the drive pins 208.

To facilitate the rotation of the female portion of the bayonet structure, which constitutes the plates 204 and 205 as well as the upper lap plate, relative to the bayonet plate 201, the plate 204 is provided with a plurality of rollers 210 which rest upon the bayonet plate 201 as illustrated in FIG. 17.

The disengagement between the structure is performed in the reverse order of rotation and for the maximum safety to the operator the relative positions between the male and female bayonet plates are recognized by a proximity switch 211. This proximity switch 211 is carried by a fixed upper structure which will be hereinafter described.

Figure 19:
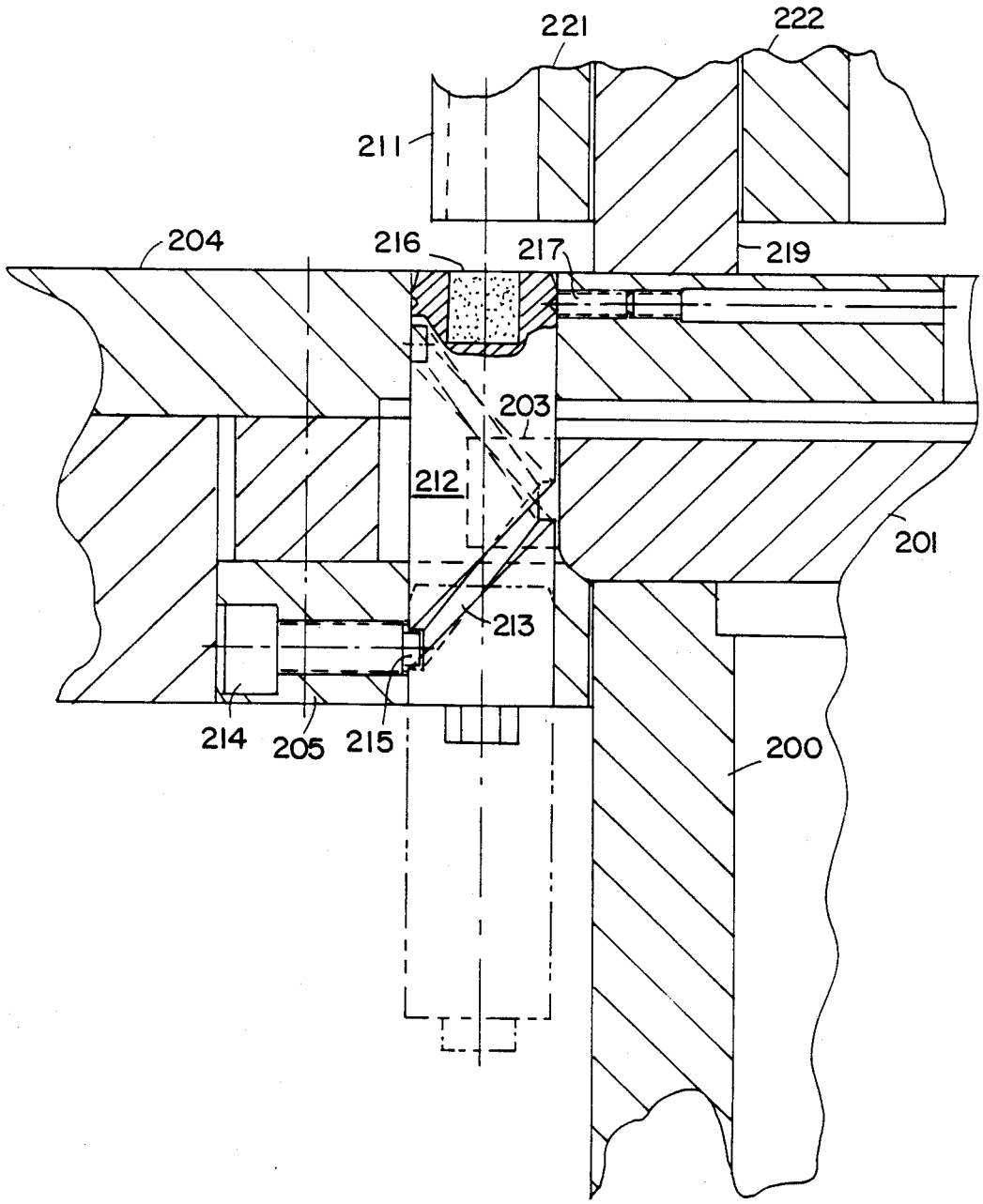
FIG. 19 is a fragmentary detailed sectional view showing the magnetic safety pin which will indicate the position of the upper lap plate of the mechanism.

Associated with the proximity switch 211 is a position indicating pin 212. This pin 212 projects through suitable aligned opening formed in plates 204 and 205, and as shown in FIG. 19 has a spiral groove 213 formed in its face. A fixed pin 214 has an end stud 215 which projects into the spiral groove 213. At the top of the pin 212 is a permanent magnet 216. The pin 212 is by a spring urged ball pin 217 releasably held in its upper position where it is embraced within the aligned openings formed in the plates 204 and 205 as shown. When the upper female bayonet structure is positioned relative to the lower male bayonet structure as heretofore described and is rotated into its driving connection position, it is necessary that the pin 212 be axially moved from its position shown in full in FIG. 19 to that of its dotted line position.

As the pin 212 is carried and thus moved with the female bayonet structure as it is rotated counter-clockwise into its position shown in FIG. 18 it must move out of the path of the teeth 203. This is accomplished by its axial rotation which causes the tip of the stud 215 to engage the spiral groove forcing the pin to travel in a downward direction as shown in FIG. 19 until it is beneath the tooth 203 allowing the same to engage the associate drive pin 208. After the physical movement and the pin 212 has cleared the tooth 203, a magnetic head 216 will draw the pin 212 back to its original position.

UPPER PLATE ELEVATED LOCKING MECHANISM (FIGS. 20 & 21)

Due to the noval arrangement of the lapping plates 22 and 34 of this invention wherein the upper lapping plate 34 is supported from underneath rather than from an overhang structure an elevated locking mechanism for the upper lap plate 34 is required.

Figure 20:
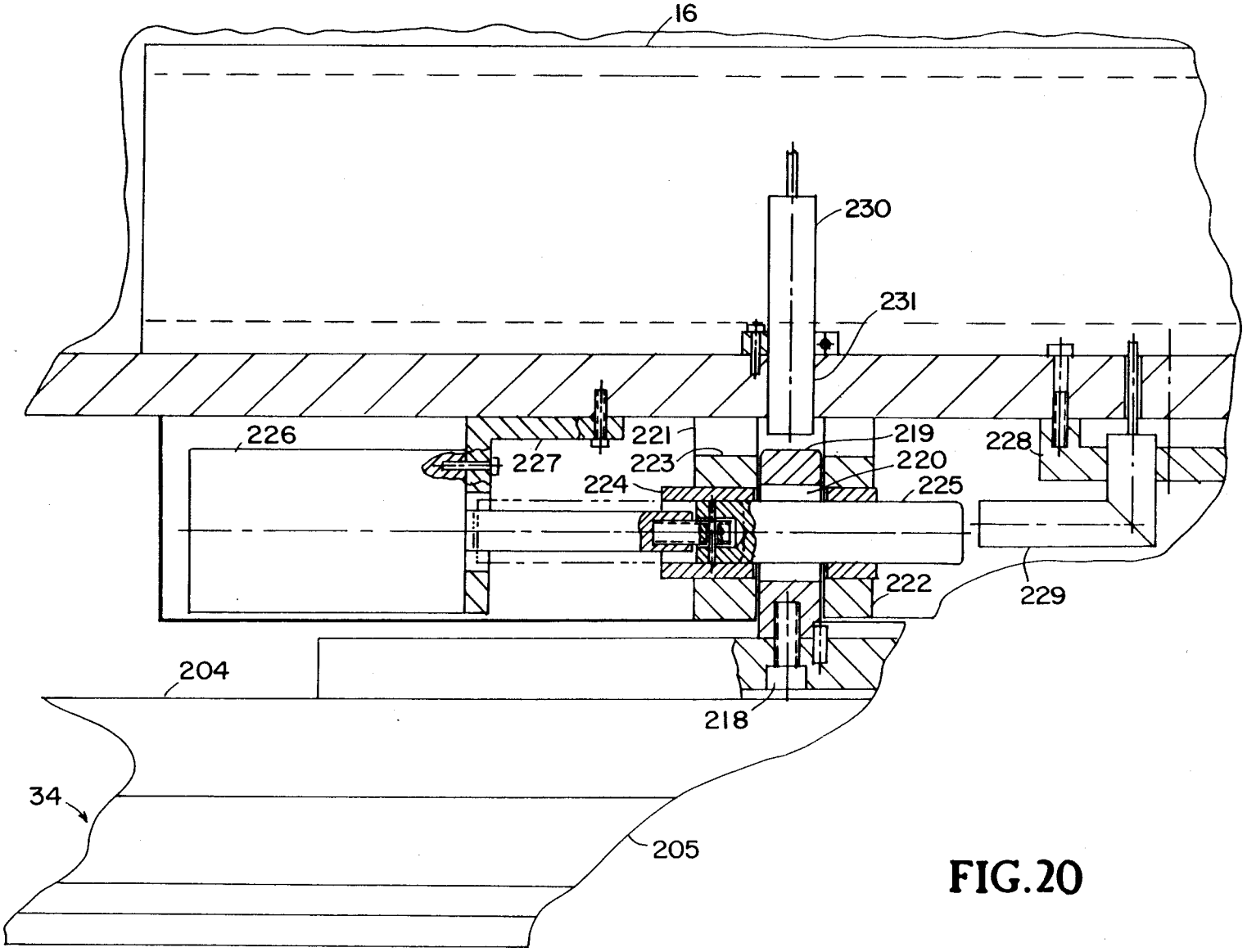
FIG. 20 is a fragmentary detailed section view of the locking mechanism for the upper lapping plate of this invention.

In FIG. 20 there is shown an upper locking mechanism which consists of a switching system comprising a number of proximity switches that perform locating and locking conformation functions.

Figure 24:
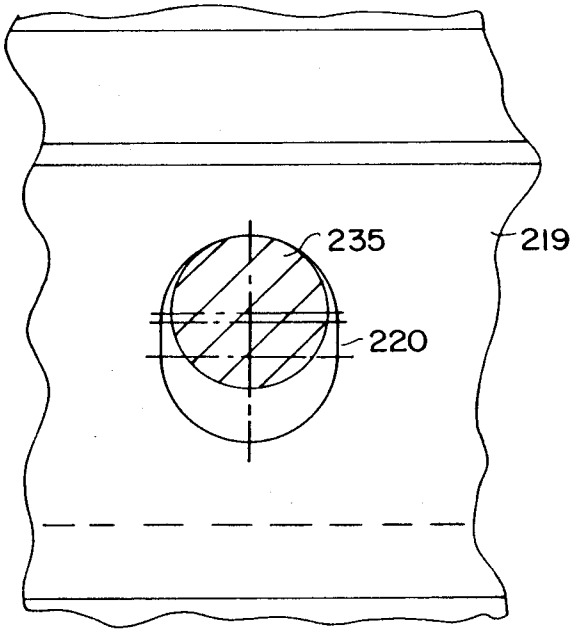
FIG. 24 is a fragmentary view similar to FIG. 23 showing the locking pin in full penetration into the retaining ring and in locking engagement therewith.
Figure 23:
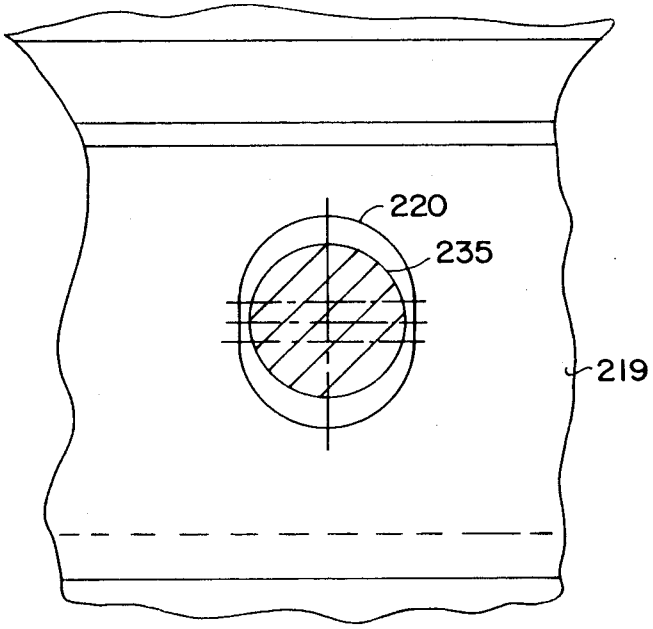
FIG. 23 is a fragmentary sectional view showing how the locking pin shown in section, penetrates the retaining ring prior to it's full locking position.

By a series of fasteners 218, a steel ring 219 is mounted on the exposed face of the upper bayonet plate 204. This ring is provided with a number of elliptical shaped slots 220 as seen in FIGS. 23 and 24, for a purpose hereinafter made apparent. The cantilever arm 16 of the machine provides two spaced apart concentric matching rings 221 and 222 which in their depending position are adapted to receive therebetween a holding ring 219 carried on the upper face of the bayonet 204.

Each of these rings 221 and 222 are provided with matching slots 223 in which is force fitted circular guides 224. These guides 224 slidably receive a plunger 225 of an air cylinder 226 which by an angle flange 227 is connected to the under side of the cantilevered arm. Within the confines of the inner ring 222 and mounted in a bracket 228 mounted to the arm is a proximity switch 229. Also mounted on the arm is a second proximity switch 230 which projects through a suitable opening 231 formed in the arm, which opening communicates with the space between the rings 221 and 222 and into which space the end of the switch 230 projects, all as is clearly illustrated in FIG. 20.

Thus when the upper plate structure is in it's raised position the ring 219 will project in the space between the rings 221 and 222. In such position the proximity switch 230 will be actuated, thus allowing the air cylinder 226 to be operated so as to project the plunger 225 through the respective slots formed in the rings 219, 221 and 222. In such a projected and locking position, plunger 225 will be in close proximity to the switch 229 thus electricially indicating the secured position of the upper lap plate structure.

As the upper bayonet plates 204 and 205 may not be connected to the lower male bayonet plate 201 it is necessary to establish the orientation of the bayonet plate 201 when the total upper lap plate structure is to be raised and locked.

Figure 21:
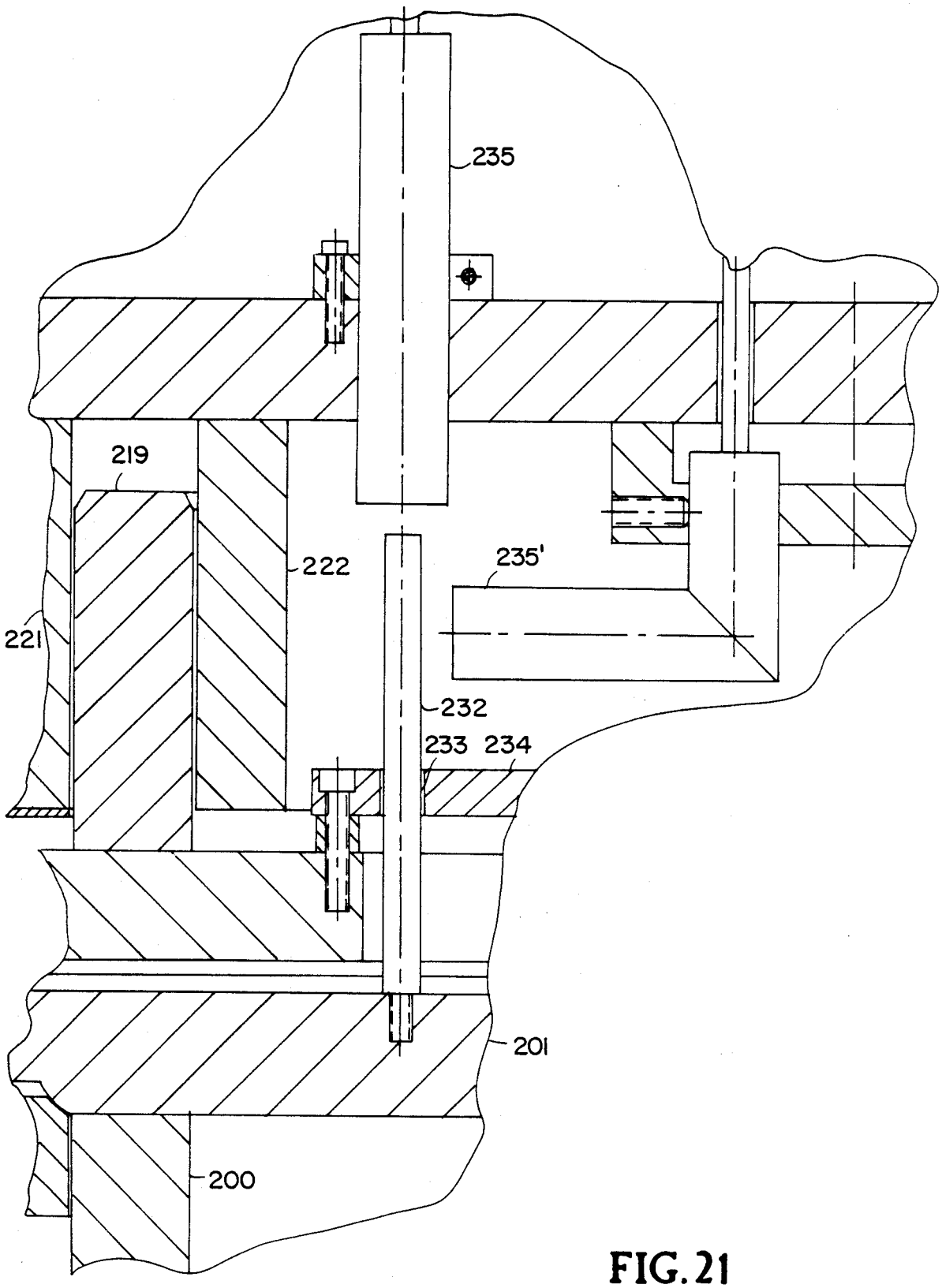
FIG. 21 is a fragmentary detailed sectional view showing the arrangement of a locating alignment pin for detecting the proper alignment of the bayonet and upper lap in it's uppermost position.
Figure 22:
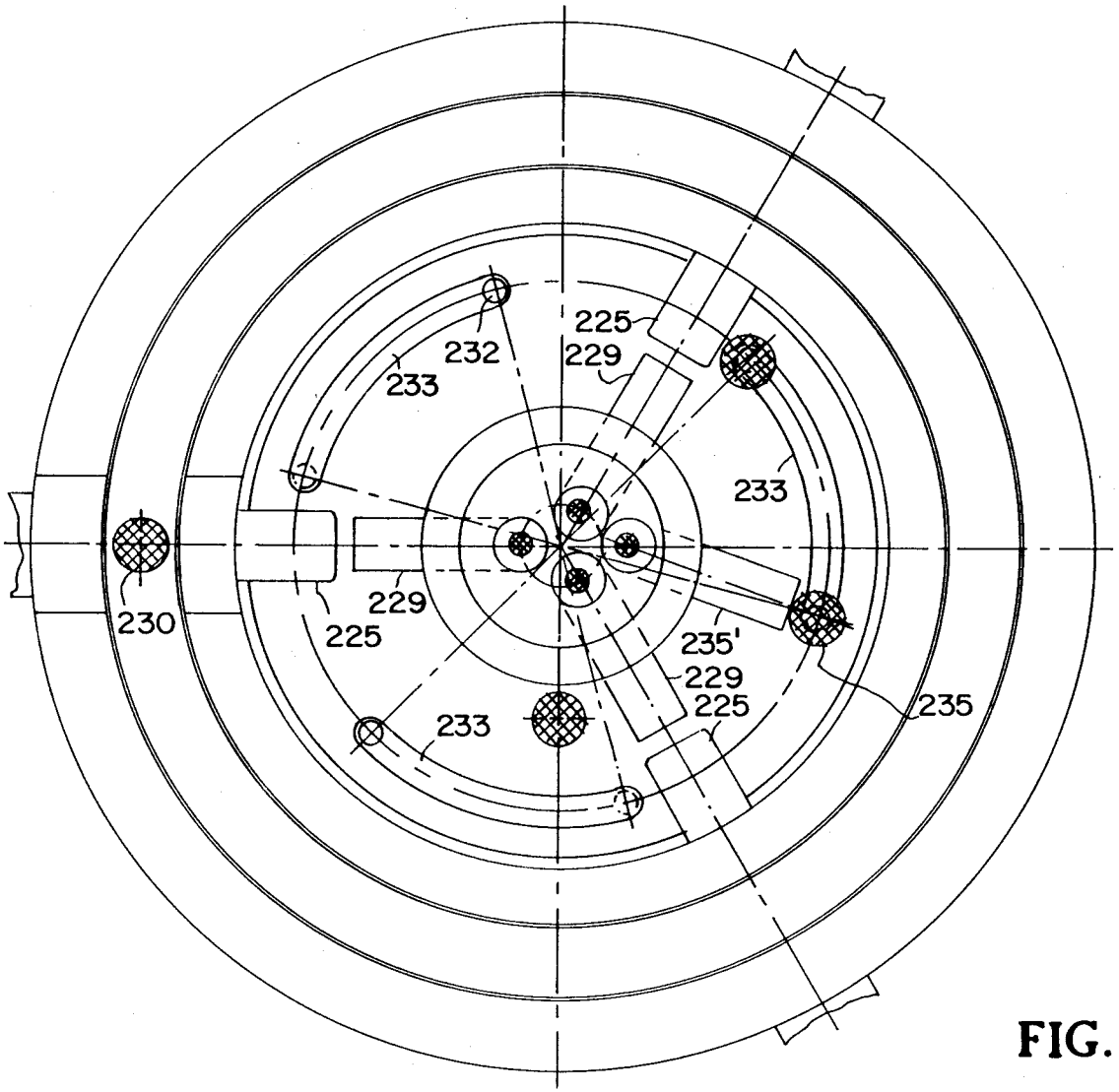
FIG. 22 is a plan view showing in detail the location of the locking pins and their respective proximity switches that indicate the pins relative positions.

To accomplish this and as shown in FIG. 21 the male bayonet plate 201 provides an alignment rod 232 which projects upwardly through a suitable arcuated slot 233 formed in a positioning plate 234 which is spaced and mounted onto plate 204 as clearly seen in FIG. 21 and 22.

This alignment rod 232 if correctly positioned, as a result of the connected rotational position of the plate 201 and 204, will in close proximity to switch 235 which in turn will so indicate the proper alignment of these structural parts.

AUTOMATIC WORK PIECE THICKNESS CONTROL SYSTEM (FIGS. 8 & 9)

A lapping and polishing machine of the type described by this invention may be equipped with a single point automatic work piece thickness control system operational during the lapping and polishing process.

Figure 8:
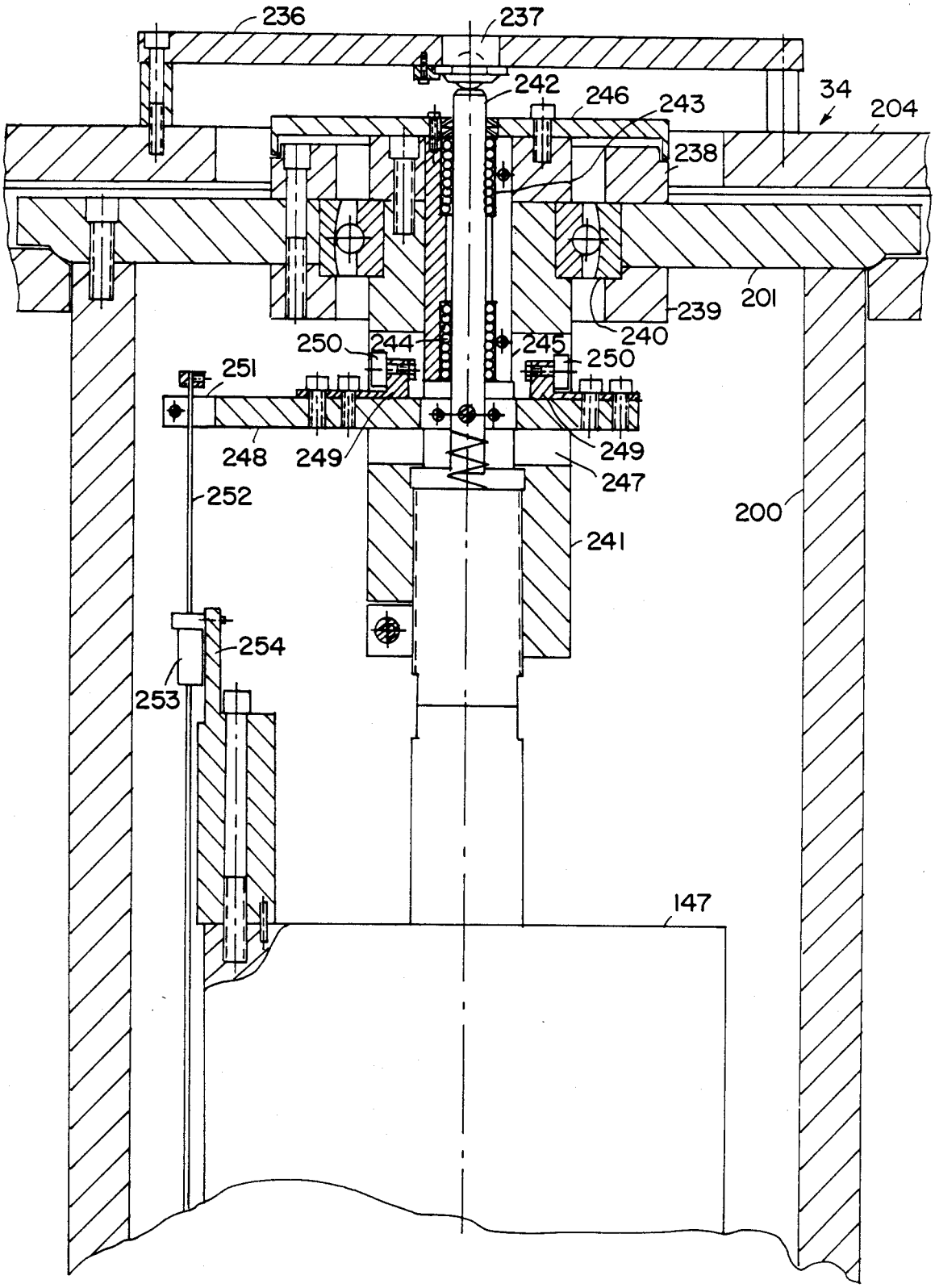
FIG. 8 is a fragmentary detailed sectional view of the single point automatic thickness control system as employed in this invention.
Figure 9:
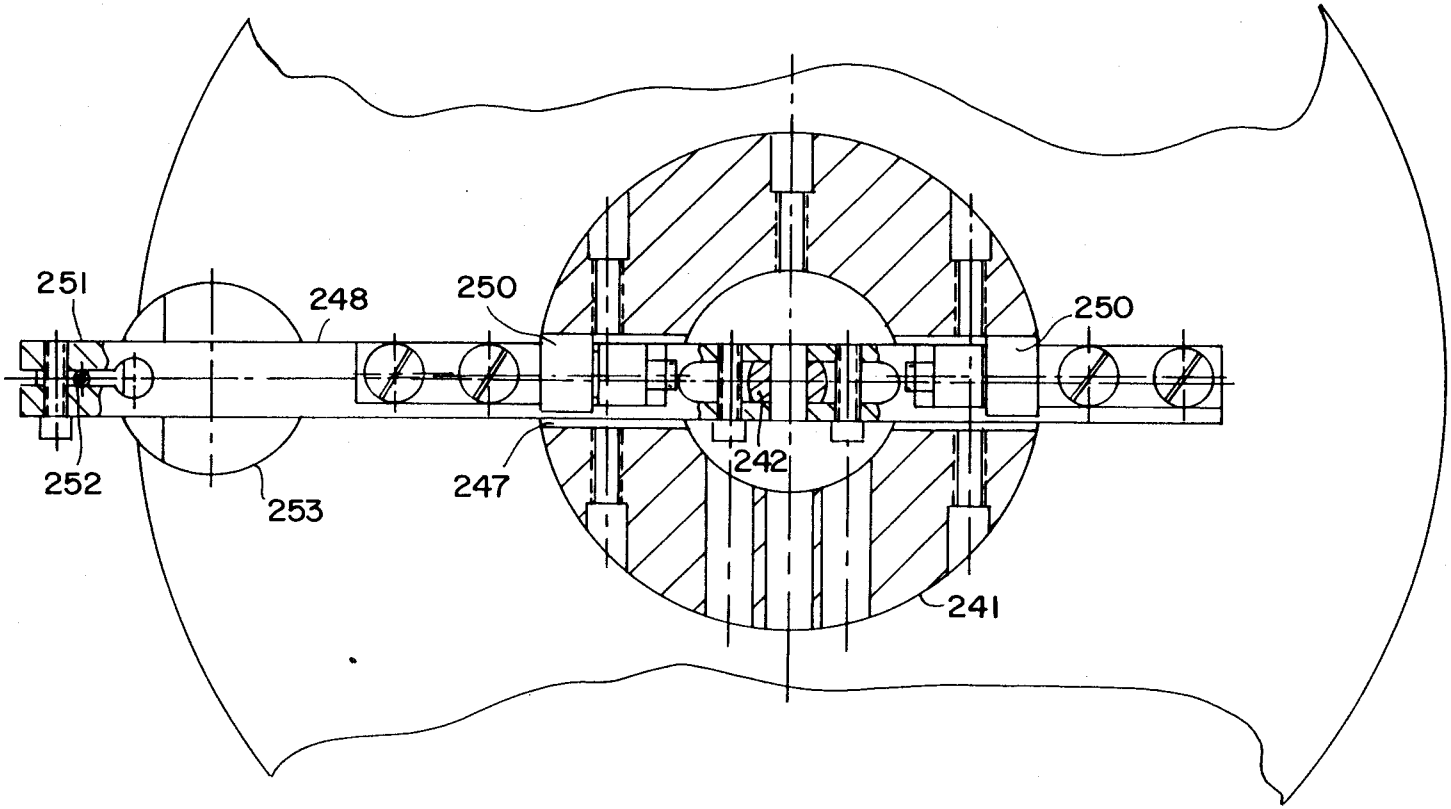
FIG. 9 is a fragmentary detailed sectional view of the support structure for the thickness control mechanism as illustrated in FIG. 8.

This system will automatically control the continuing operation of the lapping plates as they approach the desired work piece thickness. As illustrated in FIG. 8 there is fixedly attached to the exposed upper surface of the upper lap plate 34, by a series of stand off bolt connections 235', a balancing bar 236. This balancing bar 236 is mounted at the geometric center of the upper lap plate 34, and at the exact mid-point of the bar 236 hoses a universal ball bearing 237.

Mounted on top of the quill 200 is the male bayonet plate 201. Mounted in the center core of the bayonet plate 201 by means of opposing ring brackets 238 and 239 is an universal type ball bearing 240. This ball bearing engages the outer groove periphery of an elongated coupling 241, which coupling 241 is fixedly attached to the exposed piston end 51 of cylinder 52. Extending through the center bore of coupling 241 is a spring-loaded rod 242 which in turn is positioned inside of two spaced linear back-lash free bearings 243 and 244. These linear bearings 243 and 244 are contained in a partially split housing 245 and are held in place by a cap 246 attached to the upper bracket 238.

The coupling 241 is formed to provide a transversely extending slot 247. A transfer bar 248 is adapted to extend through the slot 247 and be fixedly attached to the rod 242. By means of two "L" shaped brackets 249 a pair of rollers 250 are attached to the bar 248 and are adapted to be positioned within the confines of the slot 247. These rollers 250 will bear against the inner side wall of slot 247 and will act as a backlash compensator against any axial rotation of the rod 242 developed through it's end contact with the ball transfer bearing unit 243.

The transfer bar 248 provides a split end 251 in which is fixedly mounted the upper end of a measuring rod 252. This measuring rod 252 is part of a magnascale (magnetically coded linear scale) which includes a measuring head 253 fixedly attached by a suitable mounting 254 to the cylinder 52. As the magna-scale measuring rod 252 moves through the measuring head 253 it will equate the displacement of the upper lap plate 34 due to the stock removal during the process.

This displacement of the plate 34 is transferred through ball bearing 237 onto the end of the rod 242 moving it linearly through the bearing 243 and 244, against the action of the spring. The movement of the rod 242 carries with it the transfer bar 248, which in turn moves the measuring rod 252 relative to the measuring head 253.

By this construction, and locating the movable parts in an isolated location where it is unaccessible by the fluids used during the working process of the machine, the system is easily maintained and does not require any mechanical disengagement from the upper lap plate when the latter needs to be serviced or replaced. The single point contact through the ball transfer bearing 243 automatically cancels positive and negative plate run out thereby increasing accuracy of the system.

WORKING AREA SPLASH GUARD (FIGS. 34 & 35)

The working area of the machine is provided with a splash guard that prevents centrifically generated splashing of the slurry during the lapping or polishing operation. As illustrated a segmentated splash guard in it's assembled condition will encircle the periphery of the outer pin gear drive plate.

To mount the assembled shield there is provided a channeled ed fastener 255 which by a set of screws 256 is attached to the outer periphery of the outer pin gear plate 27. The corresponding complementary edges of each of the segmented pieces 257 and 258 of the guard 259 are frictionally fitted into channels 260 formed on the opposite sides of the fastener. When each of the segments are in place they form a completed guard encircling the entire work area of the machine.

As the outer pin gear plate 27 is vertically adjusted relative to the operating surface of the lower plate 22, the splash guard being attached to such plate 27 will likewise be displaced vertically relative to the horizontally disposed surface of the lower lap plate 22 so as to not interfere with free access to the work table.

AUTOMATIC LIFT-OFF SHROUD FOR THE MACHINE (FIG. 16)

Figure 16:
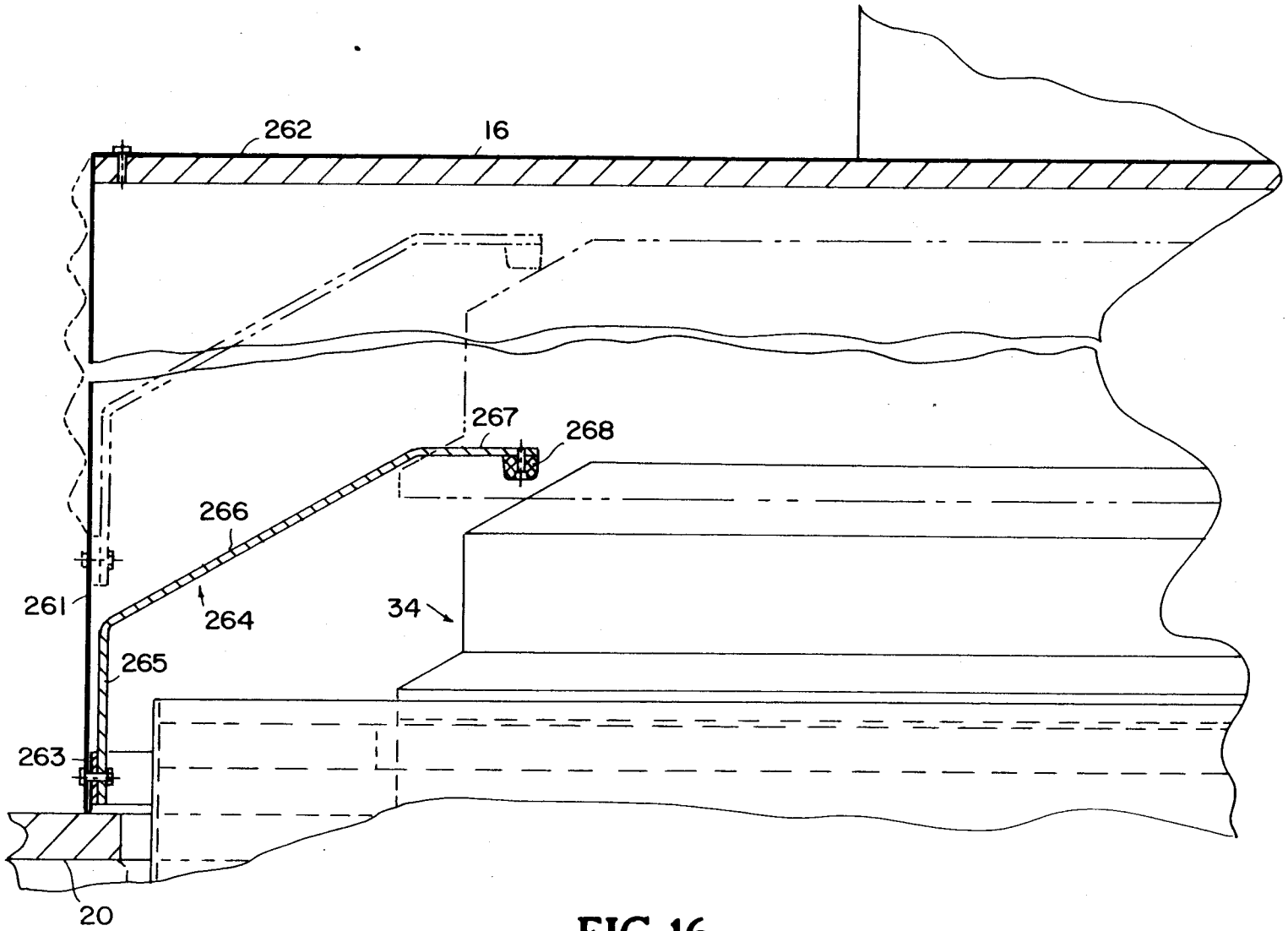
FIG. 16 is a fragmentary detailed sectional view of the automatic lift-off transparent enclosure for the work area of the lapping machine of this invention.

A transparent shroud 261 for the entire working area of the machine is provided. The top edge 262 of the shroud 261 is secured to the top arm of the machine and depends therefrom a suitable distance so as to rest upon the work table which surrounds the operating area of the machine. An annular band 265 is provided on the lower edge of the shroud 261 and has connected thereto an angular arm 264 which has a first vertical run 265, and a second included angular run 266 that terminates into a short horizontal end run 267. Mounted on the under side of the free end of the horizontal end run 267 is a bumper 268. When the upper plate 34 is elevated into the dotted line position as shown in FIG. 16, it will engage the bumper 268 and raise the shroud 261 into it's collapsed position which is also shown by the dotted lines. When the upper lap 34 is lowered into it's working position, the bumper 268 under the weight of the shroud 261 will follow it down to a point where the shroud 261 will engage the work table at which time the bumper 268 will be protectedly spaced from the lap plate 34 and will not interfere with it's rotational movement. This automatic lift-off shroud 261 provides easy access to the work area when the machine in inoperative, and provides full visability within the work area of the machine when it is operating. The shroud 261 acts to retain, for proper exhaustion, any gases developed withn the work area during operation of the machine.

The shroud 261 cooperates with the slurry splash guard 269 which it encircles when in it's lowered condition to assure complete entrapment and retention of any splashed or spilled slurry during the operation of the machine.

CLEANING SPRAY SYSTEM (FIG. 40)

Adapted to be associated with the collapsible shroud 261 is a liquid spray head 269. This spray head 269 is positioned to direct a cleaning fluid upon the exposed surface of the lower lapping plate 22 after a machine operation.

The spray head 269 is attached to the band 263 encircling the bottom edge of the collapsible shroud 261 and will be in open communication with a cleaning solution supplied through a flexible tubing (not shown) which may extend and be expandable with the band 263 while supported within the cantilevered arm 16 of the machine.

AUTOMATIC SLURRY CONTROL SYSTEM (FIG. 38)

During operational rotation of the lap plates 22 and 34 slurry or other operational fluids related to the process being performed is caused to flow between the surfaces of the plates and over their inner and outer edges. With the fluids being collected in drain tubes 270 and 271 and stored in an intermediate recovery tank 272.

Figure 38:
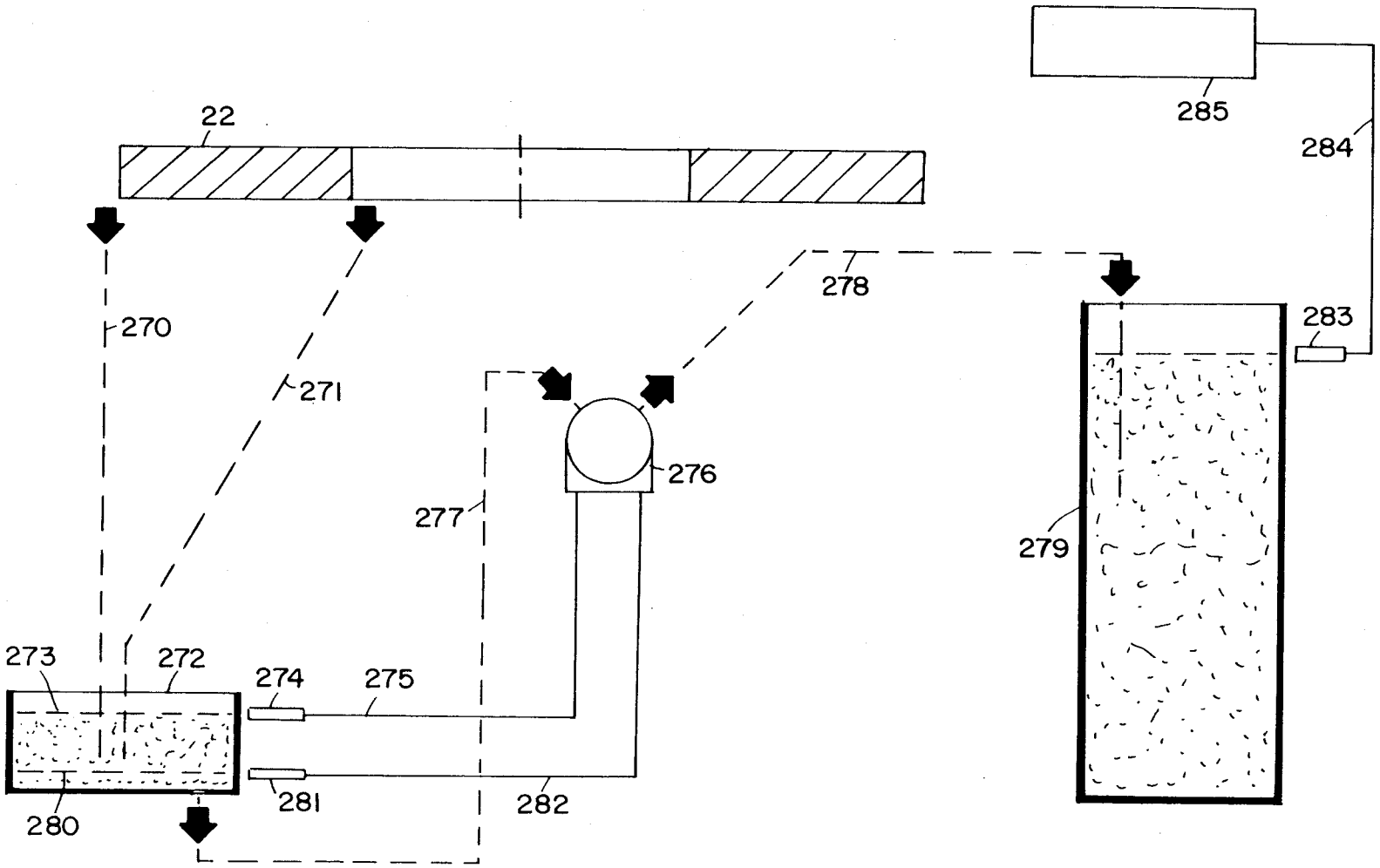
FIG. 38 is a schematic diagram showing the slurry recovery system as used in this invention

FIG. 38 schematically illustrates an automatic control system for the recovery of the slurry. As shown when the level of the fluid in tank 272 reaches the maximum indicated by the upper dotted line 273 it will be detected by the proximity switch 274, that in turn is electrically connected by conductor 275 to a pumping system 276. Upon energization of the pumping system 276 excess fluids flowing into the tank 273 are transfered through suitable pipes 277 and 278 into the storage tank 279. When sufficient recovered slurry is pumped out of the tank 273 to the minimum level indicated by the lower dotted lines 280 a second proximity switch 281 is activated and through conductor 282 commands the pumping station 286 to become inactive.

When the recovered fluid level in the tank 279 reaches it's maximum a proximity switch 283 is actuated which in turn through conductors 284 signals the operational computer 285 to produce a suitable alarm indicating such tank's capacity.

This system is also available for fluid recirculation in which case the fluid accumulated in the tank 279 is recirculated to the supply system of the apparatus.

In the event that there is a need to remove the automatic discharge control, the lower minimum liquid level switch 281 associated with the tank 272, as well as the pumping system 276 are de-energized leaving only the maximum liquid level switch 273 active. By a suitable shunt circuit (not Shown) such switch is directly connected to the computer 285 where it will activate an alarm system to prevent overflow from the tank 272.

AUTOMATIC COUNTER-BALANCE CONTROL SYSTEM (FIG. 39)

During operation the lapping plates lose a portion of their active surfaces due to material being removed by the wear pressure between them and the article being lapped. This wear gradually reduces the original predetermined wear allowance "T" (thickness) to zero "0". By reason of this wear and material removal the weight of the plates change continuously and significally, almost one third of the original weight being lost. Manual counter-balancing (bottom pressure adjusted for the plate weight) is very difficult and time consuming as well as being inaccurate to the degree required.

Figure 39:
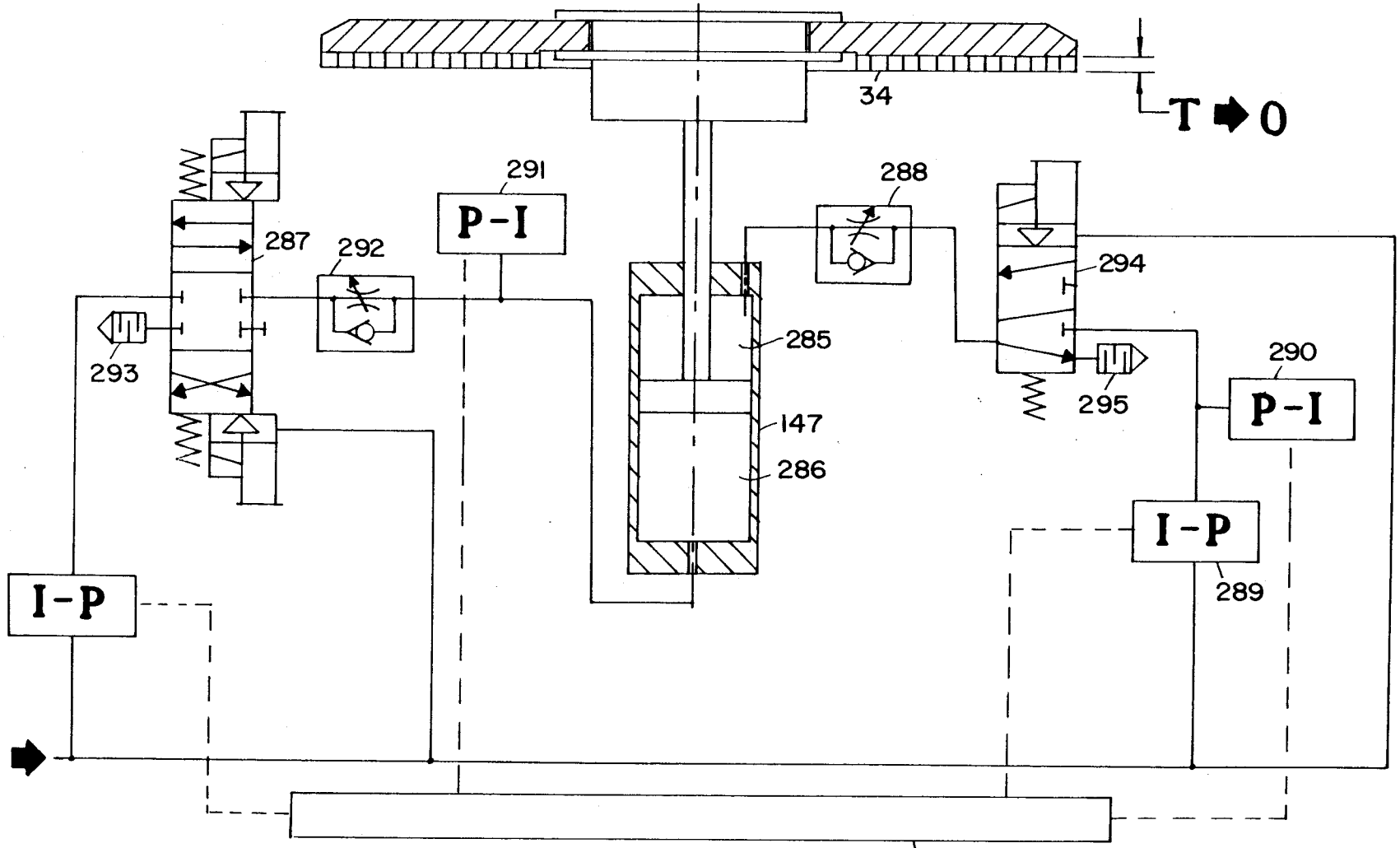
FIG. 39 is a schematic chart showing the automatic counter-balancing control system for the double wheel lapping machine of this invention.
Figure 40:
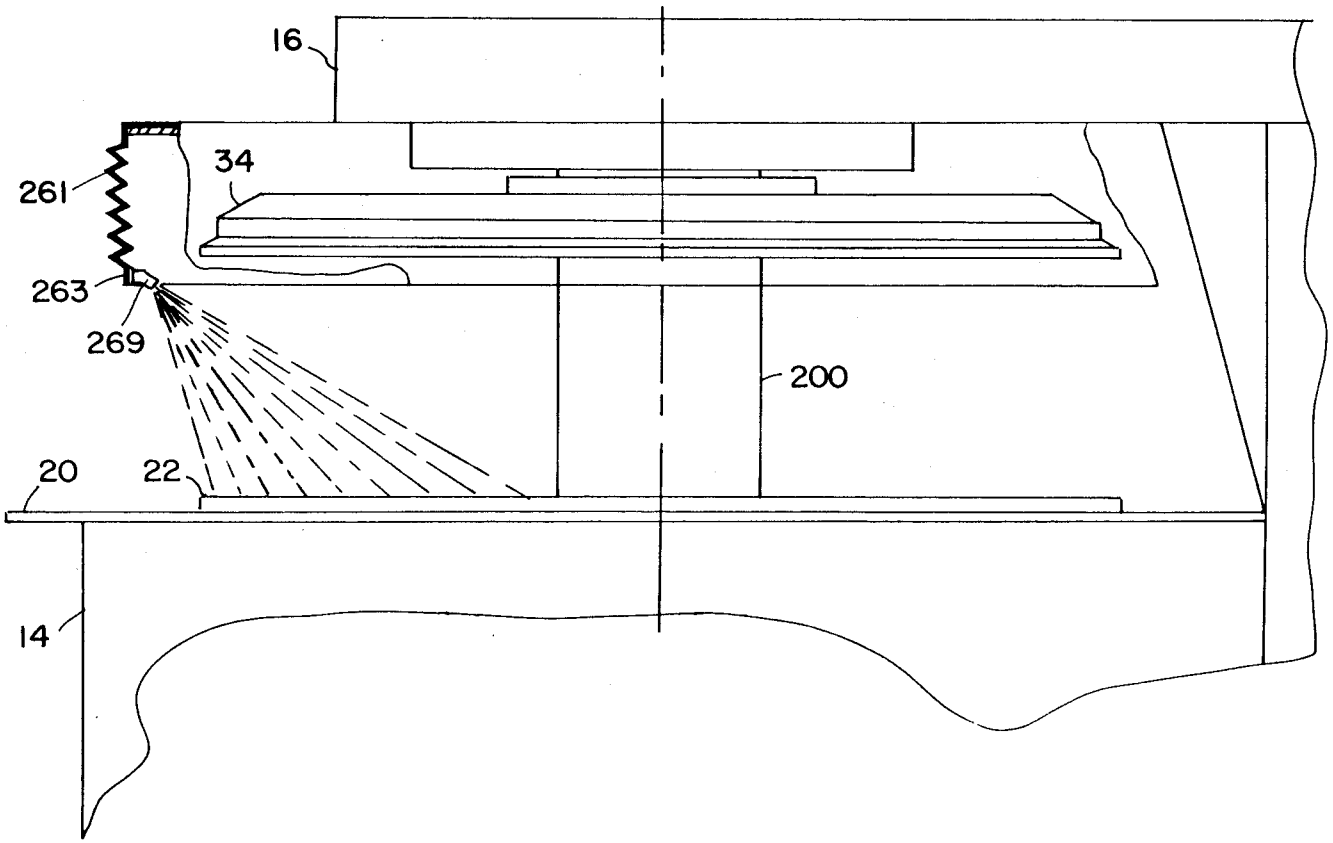
FIG. 40 is a side elevational view showing a washing system for the lower lap lapping plate of this invention.
Figure 41:
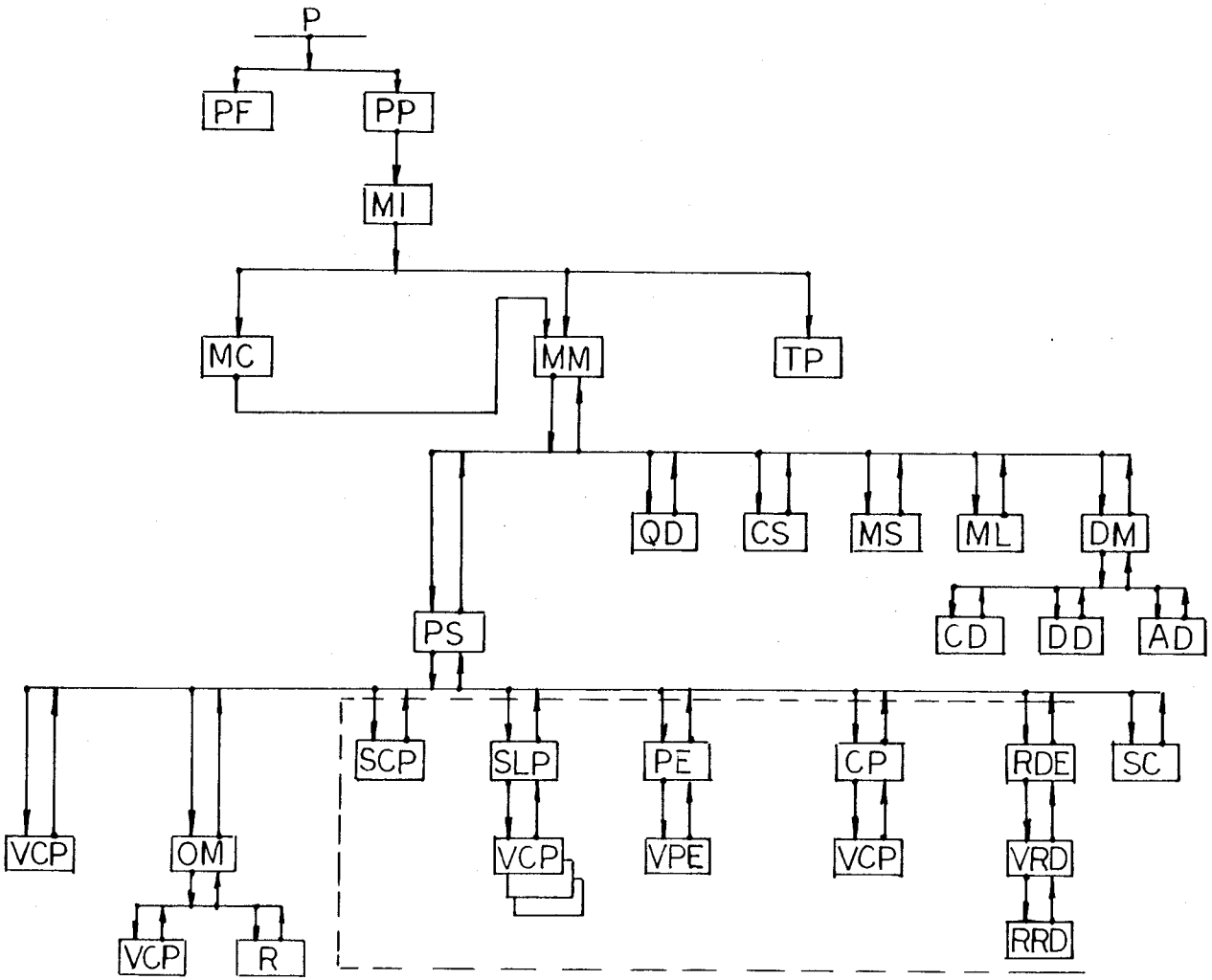
FIG. 41 is logic flow diagram for the operation of the lapping and polishing machine of this invention.
Figure 42:
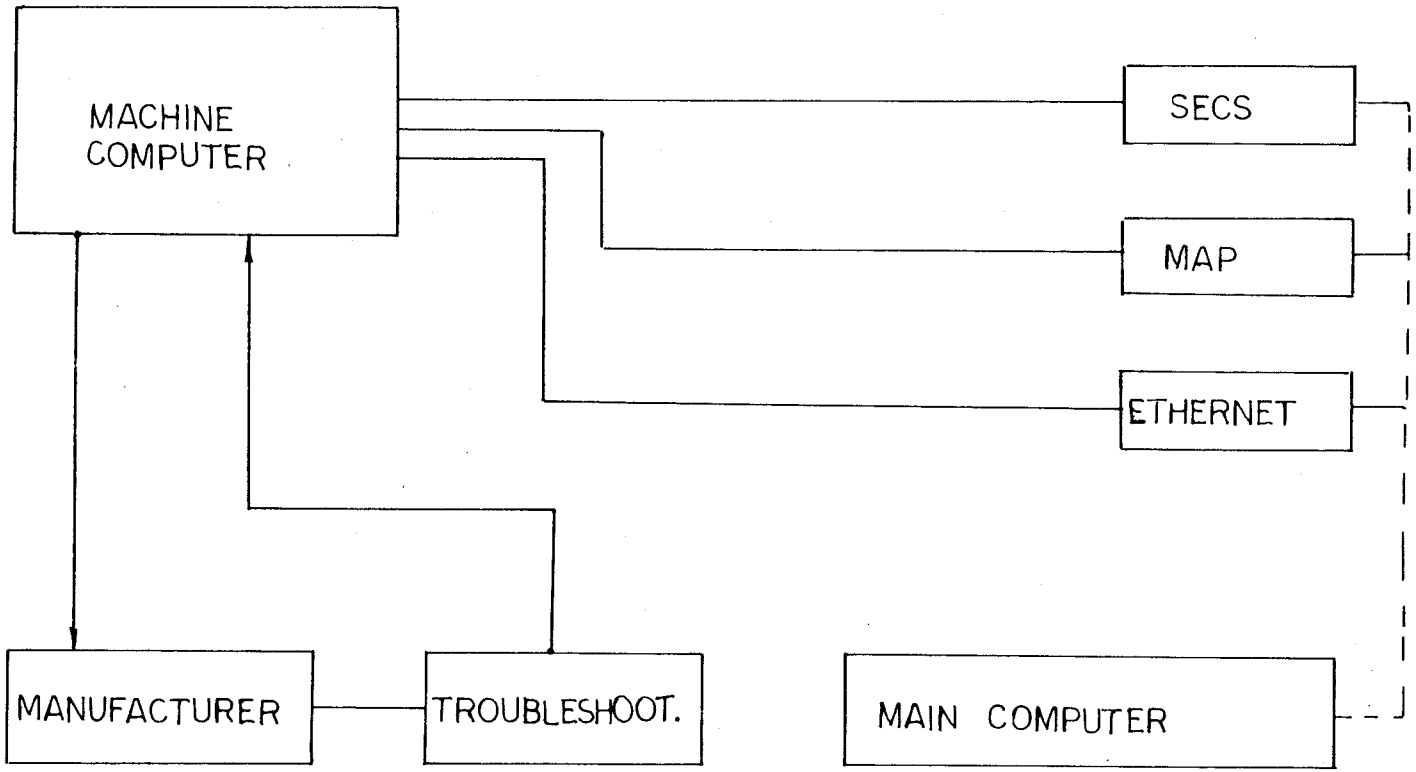
FIG. 42 is a flow chart of an expanded communication system as used by this invention.

Schematically shown in FIG. 39 is an automatic counter-balancing control system. As illustrated the upper lap plate 34 is attached to the end of a piston of the air cylinder 147 via the mechanical arrangement heretofore described.

In this system air may be delivered to the upper chamber 285 and the lower chamber 286. When the lap plate 34 is commanded to move down it starts it's descent and then dwells for a period of time to go through a weighing procedure. To accomplish the weighing procedure the bottom chamber 286 is closed by the solenoid 287. Air pressure responding to alternate weight settings is applied to the upper chamber 285. For example normal atmospheric pressure is provided in the upper chamber 285 through a muffler 295 and a open flow control valve 288. When positive pressure is admitted to the upper chamber 285 it is delivered from the main air source and is converted to appropriate electrical information by the current to pressure transducer 289. This information is signalled to the computer which controls the function of all the elements in the present circuit.

When the pressure in the lower chamber 286 stabilizes it is monitored by the tranducer 290 (pressure to current or volume to current). Transducer 290 serves as a verification unit such as a feed back response in a pressure system. Transducer 291 will measure pressure in the lower chamber 286 developed by the weight of plate 34, with or without assistance of pressure from the air source, converted by the transducer 289. Information from the transducers 291 and 289 is then converted into vertical force units. When the computer subtracts the vertical force value of transducer 291 from transducer 289 is determines the force value applied into the chamber 286 due the plates weight. This weight is automatically stored in the computer's memory to determine later counter-balance pressure values.

The lapping plate 34 continues it's descent as solenoid 287 opens and exhausts air from the lower chamber 286 through flow control value 292 and into the atmosphere via the muffler 293. The speed of descent is controied by the exhausting of air through the flow control value 292. To assist the descending action of the plate, control pressure may be admitted to the upper chamber 285.

Pre-programmed variables due to workpiece thicknesses may activate a time delay system which will control counter-balancing pressures in the lower chamber 286 when the plate 34 is approximately one inch from the workpiece. Minimum pressure to provide positive descent of the plate 34 is applied to the upper chamber 285 through the control value 288 and the activiated solenoid 294 thus creating a soft contact between the workpiece and the pressure plate.

SLURRY RECOVERY PAN EXHAUST SYSTEM (FIGS. 25 & 26)

During the operation of a lapping or polishing machine of the type embodying the inventions of this application and by reason of the material being worked, together with the slurry aggregate used, undesirable gases are created. To protect the operator of the machine and to prevent polution of the work area a suitable exhaust system for such developed gases is included in this machine.

Figure 26:
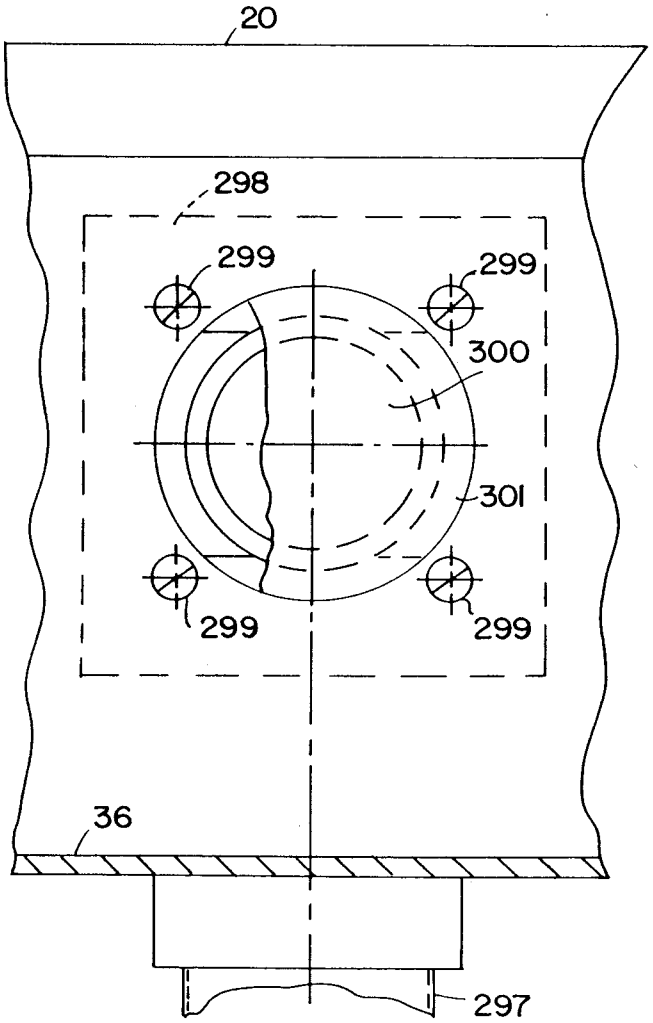
FIG. 26 is a fragmentary detailed sectional view showing a baffled entrance to the exhaust system as illustrated in FIG. 25.
Figure 25:
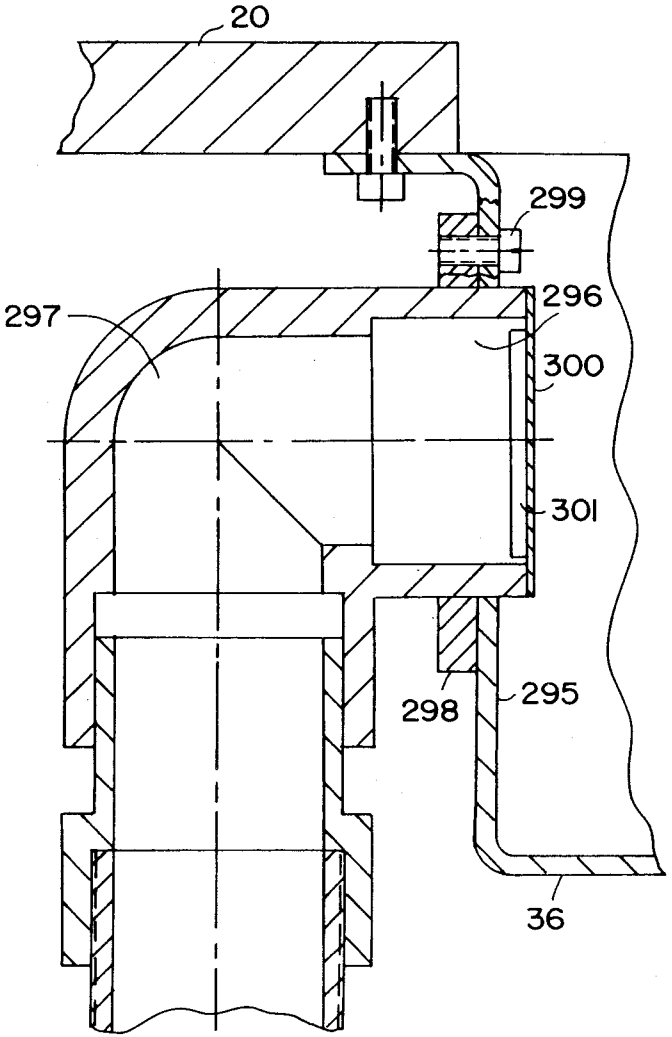
FIG. 25 is a fragmentary detailed sectional view showing an exhaust system for use with the lapping machine.

Referring to FIGS. 25 and 26 there is shown in fragmentary section the work table 20 of the machine and the associated slurry collecting pan 36. Formed in the side wall 295 of the pan 36 is an opening 296 in which is journalled a portion of an exhaust tube 297, by a suitable bracket 298 and fasteners 299 the exhaust tube 297 is held in place. A non-porous cover 300 is placed over the exhaust tube 297, with the cover providing side passages 301 through which the gases created within the pan 36 are exhausted. A suitable filter and vacuum system not shown may be associated with the continuing exhaust conduit 302.

MEANS FOR PRE-CUTTING POLISHING PAD (FIGS. 36 & 37)

The polishing pad associated with the upper lap 34 as earlier described contains a plurality of holes of the delivery of slurry therethrough. In order to greatly reduce the down time of the entire machine due to the necessity of pad changes these holes can be pre-cut in a polishing pad during machining time.

Figure 36:
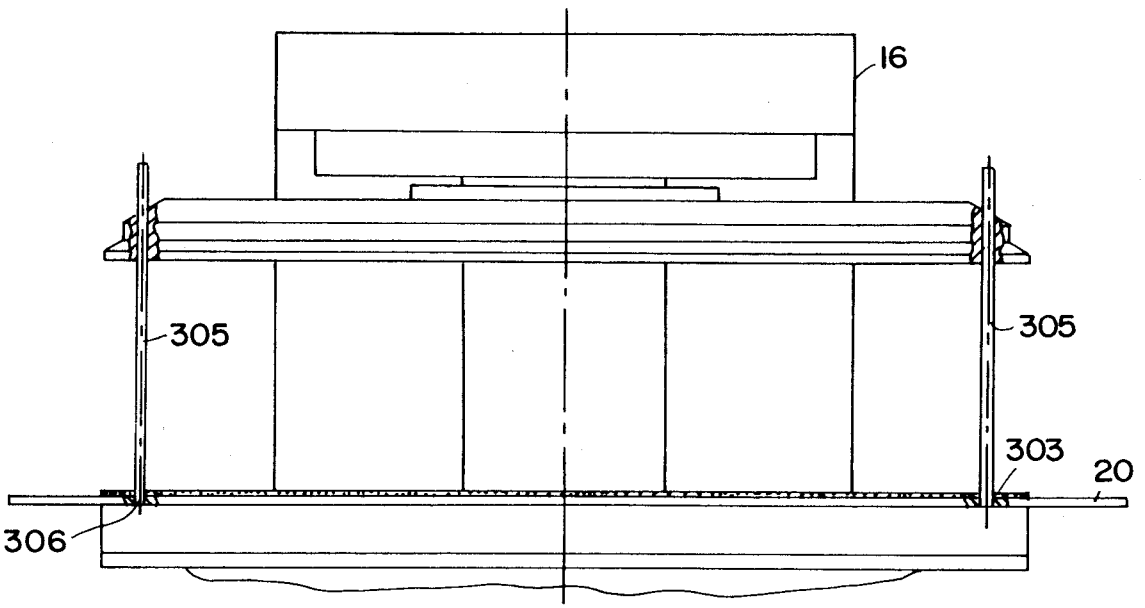
FIG. 36 is a elevational view detailed sectional view showing a fixture for use in pre-forming the slurry delivery holes in the pad.
Figure 37:
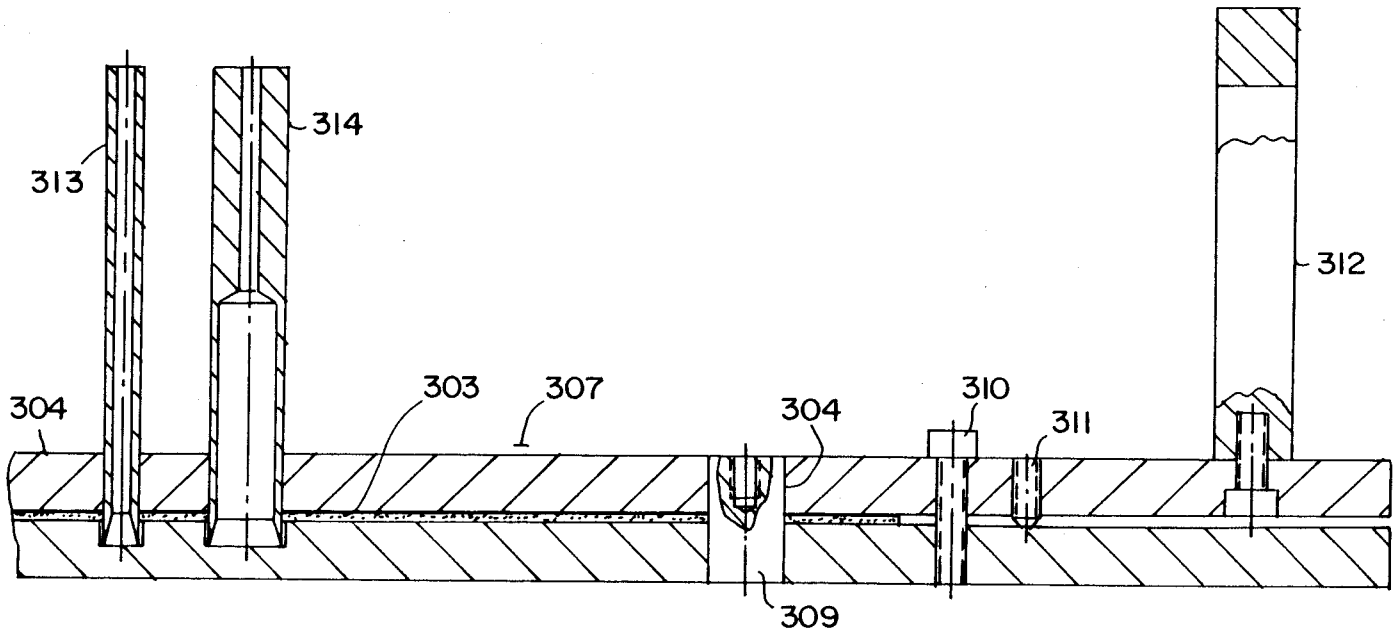
FIG. 37 is a fragmentary detailed sectional view showing the tool for simultaneously cutting the different diameter slurry delivery holes in the pad.

To accomplish the pre-cutting of the pad 303 (See FIGS. 36 and 37) a locating and working ring 304 is placed on the lower lap plate 22. This fixture ring 304 provides a series of vertically extending locating rods 305. The free ends of these rods 305 are adapted to be projected through aligning openings 306 formed in the upper lap plate 34. A punching tool 307 is illustrated in FIG. 37, it consists of a base plate 308 having a center pin 309 which is adapted to be projected through the pad 303 to be cut and into a center receiving opening formed in the ring 304. By a suitable fastener 310 the plate 308 is removably attached to the ring 304. A stop pin 311 is provided which will space the plates 308 and ring 304 apart, a distance equal to the thickness of the pad 303 to be cut. The cutting fixture 307 provides a handle 312 by which the tool is maneuvered relative to the ring 304 and pad 303. A pair of cutters 313 and 314 are provided, each of which are of a different diameter so as to form the different size openings 122 and 123 (See FIGS. 27 & 28) formed in the upper lap plate face 119. Thus through this arrangement and the tool described, a polishing pad may be pre-cut that will correspond to the pre-formed upper lapping plate 34 as herebefore described.

LOGIC FLOW DIAGRAM (FIG. 41)

The present lapping and polishing machine of this invention is to be equipped with a complete operation logic.

By engaging a power on switch "P" the control computer is energized and it's associate CRT is on. The logic system will automatically go through a self checking mode wherein if power failure is present it will be displayed at "PF" if power is positive it will be displayed at "PP". Any appropriate and necessary information relating to the displays will be indicated as such time. By pressing a master start switch pre-programmed maintenance information is displayed at "MI" this display will also recommend starting procedures and the switch will deliver power to the control components of the computerized system.

Three modes of operation are now available. Information that is made available by the manufacture of the machine and designed to make modifications to the memory of the maintenance programs responding to the functional and operating package of the machine is defined as machine configuration and is indicated at "MG". Also available is a training mode whereby operators may be instructed in the operation of the machine and the responding functions of the computer. This indicated as at "TP".

The available process functions are displayed as the main menu "MM", and from this menu one can perform and determine engagement or disengagement of the power drive quill 200 for the upper lap plate 34, this is indicated as "QD". Other menu choices are cleaning services "CS"; maintenance service "MS", maintenance log "ML", as well as a diagnostic menu, "DM" with branch lines including control diagnostic, "CD"; digital diagnostic, "DD"; and analog diagnostics "AD".

The flow chart illustrates that the system will now display the current program process "VCP". An operational menu "OM" is activated allowing you to run the process "R" and view the process parameters "VCP".

The items encompassed within the dotted lines "D" designates that the operational password is required to incorporate the following functions into the computerized process. Within this area the item "SCP" permits you to store the current process into the computer library. Item "SLP" allows you to select processes from the library which after viewing can be either returned to the library or loaded into the active memory "VCP". Item "PE" permits entry of new process parameters into active memory or into the library while being viewed on "VPE".

Item "CP" allows you to change the process in current memory while the machine is not activated viewing it on item "VCP" and reentering the changed process into current memroy. Item "RDE" allows you to change process parameters during the running cycle of the machine while view it on "VRD" and activating it on "RRD".

The system also encludes item "SC" which permits dressing of the polishing pad and conditioning the plate surface using a preprogrammed process or with a special option code to vary manufacturer's process to one of a specific customer's demand.

EXPANDED COMMUNICATION SYSTEM (FIG. 42)

To satisfy the demand for an expanded communication system usable with a computer intergrated manufacturing system there is provided the compatibility of this machine with most commonly usable systems such as "SECS", and "MAP", as well as "ETHERNET". There are herein indicated as examples and are not to be considered a limitation to the compatibility of the present invention.

All of the above mentioned systems allow the computerized apparatus of this invention to be controlled by a main supervising computer programed to the customer's manufacturing operations. An additional feature is added which incorporates remote trouble shooting. It has become a source of major concern, and time loss for most customers required to repair and maintain their current equipment quickly and efficiently that the supplier of the program with it's expertise base is located far from the customer's plant.

With the disclosed system and utilizing modern communications the machine control system can be examined remotely by down loading the data from the remote locations automatically into the manufacturer's computer system. This is achieved by a special coded command that will establish a communication line whereby the manufacturer's personnel can receive the necessary information, determine the problem, cause and supply necessary instructions and/or components for replacement in the shortest possible time frame.

While I have illustrated and described the preferred form of construction for carrying my invention into effect, this is capable of variation and modification without departing from the spirit of the invention, I therefore, do not wish to be limited to the precise details of construction as set forth, but desire to avail myself to such variation and modifications as come within the scope of the appended claims.

Having thus described my invention what I claim as new and desire to protect by Letters Patent is:

1. A lapping and polishing machine having horizontally disposed dual lapping and polishing plates rotatable about their center axis, including:

(a) means for supporting one of the lapping and polishing plates for rotation about its center axis, (b) means for rotating said one lapping and polishing plate about its center axis, (c) means extending through the center axis of said one lapping and polishing plate for supporting the other of the lapping and polishing plate for rotation about its center axis, (d) means for rotating said other of the lapping and polishing plates about its center axis, (e) means within the center axes of both of the lapping and polishing plates for vertically moving said other lapping and polishing plate away from said one lapping and polishing plates, and (f) means for releasibly locking said other lapping and polishing plate in spaced elevated position relative to said one lapping and polishing plate independently of said vertically moving means, said supporting means said rotating means for said other lapping and polishing plate.

2. A lapping and polishing machine having horizontally disposed dual lapping and polishing plates as defined by claim 1 wherein said means supporting said one lapping and polishing plate for rotation about it's center axis comprises a ring-like rotary union.

3. A lapping and polishing machine having horizontally disposed dual lapping and polishing plates as defined by claim 2 wherein said rotary union comprises a stationary ring-like center core positioned within a rotatable outer ring with the confronting peripheral walls of said core and said ring having complimentary fluid channels formed therein with the fluid channel of said core having open communication with a fluid supply source and the fluid channel of the outer ring having communication with said one lapping and polishing plate and including a fluid receptacle beneath the confronting peripheral walls of said core and said ring for the collection of fluids leaking from said channels and between said walls and with said receptacle providing an exhaust in communication with a fluid leakage detector.

4. A lapping and polishing machine having horizontally disposed dual lapping and polishing plates as defined by claim 1 wherein said means extending through the center axis of said one lapping and polishing plate for supporting said other lapping and polishing plate includes a hollow quill rotatable about and vertically movable along a center axis.

5. A lapping and polishing machine having horizontally disposed dual lapping and polishing plates as defined by claim 4 wherein said means supporting said one lapping and polishing plate for rotation about it's center axis comprises a ring-like rotary union through which said hollow quill is freely journalled.

6. A lapping and polishing machine having horizontaly disposed dual lapping and polishing plates as defined by claim 4 including means for detachably connecting said other lapping and polishing plate from said quill so as to be suspended in spaced vertical relation to said one lapping and polishing plate.

7. A lapping and polishing machine having horizontally disposed dual lapping and polishing plates as defined by claim 6 wherein said means for detachably connecting said other lapping and polishing plate from said quill includes a horizontally disposed circular plate connected to the free end of said quill with said plate having radially projecting bayonet members spaced about it's periphery with said other lapping and polishing plate providing an open concentric core the peripheral wall of which has a plurality of receiving and locking slots for the reception and retention therein of said bayonet members when said other lapping and polishing plate is rotated in one direction relative to said circular plate carried by said quill.

8. A lapping and polishing machine having horizontally disposed dual lapping and polishing plates as defined by claim 4 wherein said means for supporting one of the lapping and polishing plate includes a rotary union comprising a stationary ring-like center core positioned about said quill and within a rotatable outer ring connected to and rotatable with said quill with the confronting peripheral walls of said core and said ring having complimentary fluid channels formed therein with the fluid channel of said core having open communication with a fluid supply source and the fluid channel of the outer ring having continuous communication with said one lapping and polishing plate and including a fluid receptacle beneath the confronting peripheral walls of said core and said ring for the collection of fluids leaking from said channels and between said walls with said receptacle providing an exhaust in communication with a fluid leakage detector.

9. A lapping and polishing machine having horizontally disposed dual lapping and polishing plates as defined by claim 1 wherein said means within the center axes of said lapping and polishing plates for moving said other lapping and polishing plate vertically comprises a pneumatic cylinder including a movable piston fixedly connected to said other lapping and polishing plate.

10. A lapping and polishing machine having horizontally disposed dual lapping and polishing plates as defined by claim 9 wherein said means supporting said one lapping and polishing plate for rotation about it's center axis comprises a ring-like rotary union.

11. A lapping and polishing machine having horizontally disposed dual lapping and polishing plates as defined by claim 9 wherein said means extending through the center axis of said one lapping and polishing plate for supporting said other lapping and polishing plate includes a hollow quill surrounding said pneumatic cylinder with said quill connected to said other lapping and polishing plate so as to be rotatable about and vertically movable along it's center axis by said pneumatic cylinder.

12. A lapping and polishing machine having horizontally disposed dual lapping and polishing plates as defined by claim 9 including means for detachably connecting said other lapping and polishing plate from said movable piston of said pneumatic cylinder so as to suspend said other lapping and polishing plate in a vertically spaced position relative to said one lapping and polishing plate.

13. A lapping and polishing machine having horizontally disposed dual lapping and polishing plates as defined by claim 12 wherein said means for detachably connecting said other lapping and polishing plate from said movable piston includes a horizontally disposed circular plate connected to the free end of said movable piston with said plate providing radially projecting bayonet members spaced about it's periphery with said other lapping and polishing plate providing an open concentric core having a diameter larger than said circular plate so as to receive the same therein with the peripheral walls of said core having a plurality of receiving and locking slots for the reception and retention therein of said bayonet members when said other lapping and polishing plate is rotated in one direction about the center axis of said piston.

14. A lapping and polishing machine having horizontally disposed dual lapping and polishing plates as defined by claim 9 including means for adjustably supporting said pneumatic cylinder relative to said other lapping and polishing plate so as to maintain said cylinder in a true vertical plane.

15. A lapping and polishing machine having horizontally disposed dual lapping and polishing plates as defined by claim 1 wherein said means for releasibly locking said other lapping and polishing plate in an elevated position comprises a locking ring mounted on the top surface of said other lapping and polishing plate and a ring-like receptacle provided by the machine and adapted to receive therein said locking ring when said other lapping and polishing plate is vertically spaced from said one lapping and polishing plate by said moving means, and locking means cooperating with said locking ring and said ring-like receptacle for releasably locking said parts in a mated position.

16. A lapping and polishing machine having horizontally disposed dual lapping and polishing plates as defined by claim 15 wherein said means within the center axes of said lapping and polishing plates for vertically moving said other lapping and polishing plate with said locking ring into mating relation with said ring-like receptacle comprises a pneumatic cylinder including a movable piston fixedly connected to said other lapping and polishing plate.

17. A lapping and polishing machine having horizontally disposed dual lapping and polishing plates as defined by claim 16 wherein said means extending through the center axis of said one lapping and polishing plate for supporting said other lapping and polishing plate includes a hollow quill connected to said other lapping and polishing plate so as to be rotatable about and vertically movable along it's center axis by said pneumatic cylinder.

18. A lapping and polishing machine having horizontally disposed dual lapping and polishing plates as defined by claim 15 including means for detachably connecting said other lapping and polishing plate from said moving means when said locking ring carried thereby is releasably locked in it's mating position with said ring-like receptacle, so as to be suspended in spaced vertical relation to said one lapping and polishing plate.

19. A lapping and polishing machine having horizontally disposed dual lapping and polishing plates as defined by claim 1 wherein said means for supporting one of the lapping and polishing plates includes a rotary union comprising a stationary ring-like center core positioned within a rotatable outer ring with the confronting peripheral walls of said core and said ring having complimentary fluid channels formed therein with the fluid channels of said core having open communications with a fluid supply source and the fluid channel of the outer ring having communication with said one lapping and polishing plate and including a fluid receptacle beneath the confronting peripheral walls of said core and said ring for the collection of fluids leaking from said channels and between said walls and with said receptacle providing an exhaust in communication with a fluid leakage detector.

20. A lapping and polishing machine having horizontally disposed dual lapping and polishing plates as defined by claim 1 including a workpiece carrier for positioning workpieces between the dual lapping and polishing plates and having means for rotating said carrier about it's own axis independently of the rotation of the dual lapping and polishing plates.

21. A lapping and polishing machine having horizontally disposed dual lapping and polishing plates as defined by claim 20 wherein said means for rotating said carrier about it's own axis comprises a planetary gear pin system including an inner ring of gear pins adapted to tangently engage the periphery of said carrier and an outer gear ring adapted to simultaneously tangenetly contact said carrier for causing rotation of the same about it's own axis.

22. A lapping and polishing machine having horizontally disposed dual lapping and polishing plates as defined by claim 21 including means on said gear pins providing rolling driving contact with said workpiece carrier as the same is caused to rotate about it's own axis.

23. A lapping and polishing machine having horizontally disposed dual lapping and polishing plates as defined by claim 22 wherein said means providing rolling contact between said gear pins and said carrier comprise ball bearing supported rollers mounted at the free ends of said pins.

24. A lapping and polishing machine having horizontally disposed dual lapping and polishing plates as defined by claim 21 including means for adjusting through a vertical axis said inner ring of gear pins to maintain the same in engagable positioned with the periphery of said carrier.

25. A lapping and polishing machine having horizontally disposed dual lapping and polishing platess as defined by claim 21 including means for vertically moving said outer gear ring relative to said one lapping and polishing plate so as to displace the gear pins on said outer gear ring out of the horizontal plane of said one lapping and polishing plate so as to permit removal of said workpiece carrier and the workpieces carried thereby off the exposed surface of said one lapping and polishing plate.

26. A lapping and polishing machine having horizontally disposed dual lapping and polishing plates as defined by claim 25 including a fixed vertically extending splash guard mounted on said outer gear ring and movable therewith out of the horizontal plane of said one lapping and polishing plate.

27. A lapping and polishing machine having horizontally disposed dual lapping and polishing plates as defined by claim 1 including a series of proximity switches for indicating the elevated position of said other lapping and polishing plate and for energizing indicators showing the locked position of said other lapping and polishing plate.

28. A lapping and polishing machine having horizontally disposed dual lapping and polishing plates as defined by claim 1 including a workpiece thickness control for the workpieces being lapped or polished, said control consisting of a single point balanced bar mounted on said other lapping and polishing plate and a balance bar responsive indicating rod including a movement sensor corresponding to the reflected movement of said balancing bar caused by the rotational movement of said other lapping and polishing plate.

29. A lapping and polishing machine having horizontally disposed dual lapping and polishing plates as defined by claim 1 including means detachably connecting said other of said lapping and polishing plates to its supporting means, and means detachably connecting said other of said lapping and polishing plates to its rotating means, whereby said other of said lapping and polishing plate may be locked in a suspended disengaged condition relative to its supporting means and rotating means and said one lappng and polishing plate.

30. A lapping and polishing machine having horizontally disposed dual lapping and polishing plates as defined by claim 2 wherein said means for detachably connecting said supporting means from said other lapping and polishing plate includes a horizontally disposed circular plate connected to said supporting means and having radially projecting bayonet members spaced about it's periphery, with said other lapping and polishing plate providing an open concentric core, the peripheral wall of which has a plurality of receiving and locking slots for the reception and retention therein of said bayonet members when said other lapping and polishing plate is rotated in one direction relative to said circular plate carried by said supporting means.

31. A lapping and polishing machine having horizontally disposed dual lapping and polishing plates as defined by claim 29 including a series of proximity switches for energizing indicators showing the attached connection between said other lapping and polishing plate and it's supporting means.

* * * * *